US007594621B2

(12) United States Patent
Inui et al.

(10) Patent No.: US 7,594,621 B2
(45) **Date of Patent: *Sep. 29, 2009**

(54) LEVEL WOUND COIL, METHOD OF MANUFACTURING SAME, AND PACKAGE FOR SAME

(75) Inventors: Kenichi Inui, Tsuchiura (JP); Yusuke Takenaga, Inashiki-gun (JP); Tomo Kawano, Ishioka (JP); Katsumi Nomura, Tsuchiura (JP); Mamoru Houfuku, Inashiki-gun (JP); Ken Horiguchi, Tsuchiura (JP)

(73) Assignee: Hitachi Cable, Ltd., Tokyo (JP)

( * ) Notice: Subject to any disclaimer, the term of this patent is extended or adjusted under 35 U.S.C. 154(b) by 349 days.

This patent is subject to a terminal disclaimer.

(21) Appl. No.: 11/641,961

(22) Filed: Dec. 20, 2006

(65) Prior Publication Data

US 2007/0175035 A1 Aug. 2, 2007

(30) Foreign Application Priority Data

Dec. 21, 2005 (JP) ..... 2005-367512
Sep. 29, 2006 (JP) ..... 2006-268383

(51) Int. Cl.
*B65H 55/04* (2006.01)

(52) U.S. Cl. ..... 242/174; 242/476.7

(58) Field of Classification Search ..... 242/174–178, 242/476.7, 478.1, 484, 484.1, 484.4
See application file for complete search history.

(56) References Cited

U.S. PATENT DOCUMENTS 5,193,761 A * 3/1993 Fritz et al. ..... 242/159

FOREIGN PATENT DOCUMENTS

JP 2002-370869 A 12/2002

* cited by examiner

*Primary Examiner*—John Q. Nguyen
*Assistant Examiner*—William E Dondero
(74) *Attorney, Agent, or Firm*—Foley & Lardner LLP

(57) ABSTRACT

A level wound coil (LWC) having a plurality of coil layers each of which has a pipe wound in alignment winding and in traverse winding. The LWC has a shift section where the pipe is shifted from the m-th coil layer to the (m+1)-th coil layer on a bottom surface thereof when the LWC is disposed on a mount surface. The shift section has the k-th shift section on inner layer side and the (k+1)-th shift section on outer layer side, where a start point of the (k+1)-th shift section does not transit, relative to a start point of the k-th shift section, to a direction reverse to a winding direction of the pipe. A length of the shift section that does not transit to the reverse direction is controlled.

7 Claims, 18 Drawing Sheets

LEVEL WOUND COIL, METHOD OF MANUFACTURING SAME, AND PACKAGE FOR SAME

The present application is based on Japanese patent application Nos. 2005-367512 and 2006-268383 filed Dec. 21, 2005 and Sep. 29, 2006, respectively, the entire contents of which are incorporated herein by reference.

BACKGROUND OF THE INVENTION

1. Field of the Invention

This invention relates to a level wound coil (hereinafter called as "LWC"), a method of manufacturing the LWC and a package for the LWC, and more particularly, to an LWC that is formed winding a metal pipe, such as a copper and copper alloy pipe, which is used as a heat transfer pipe of an air-conditioning heat exchanger, a water pipe etc. Furthermore, this invention relates to a method of manufacturing the LWC and a package for the LWC.

2. Description of the Related Art

A heat transfer pipe such as an inner grooved tube/pipe and a smooth (plain) tube/pipe is used for the air-conditioning heat exchanger, the water pipe etc. The heat transfer pipe is typically formed of a copper or copper alloy pipe (hereinafter simply called as "copper pipe"). In the manufacturing process thereof, the pipe is coiled and then annealed into a given tempered material. Then, it is stored or transported in the form of the LWC. In use, the LWC is uncoiled and cut into a pipe with a desired length.

When the LWC is used, the copper pipe is fed out from the LWC by using a copper pipe feeding apparatus (uncoiler). For example, JP-A-2002-370869 discloses a copper pipe feeding apparatus, which will be explained below.

FIGS. 13A and 13B are diagrams showing conventional copper pipe feeding apparatuses. FIG. 13A is a perspective view showing a conventional copper pipe feeding apparatus (vertical uncoiler). FIG. 13B is a perspective view showing a conventional copper pipe feeding apparatus (horizontal uncoiler).

As shown in FIG. 13A, the copper pipe feeding apparatus 10A is operated such that a bobbin 21 with an LWC 20 coiled around there is vertically attached, and a copper pipe 22 is fed from the bobbin 21 while being guided by a guide 11 in a feeding direction. Then, it is cut into a pipe with a desired length by a cutter (not shown).

As shown in FIG. 13B, the copper pipe feeding apparatus 10B is operated such that the bobbin 21 with the LWC 20 coiled around there is horizontally disposed on a turntable 12, and the copper pipe 22 is fed from the bobbin 21 while being guided by a guide 13 in a feeding direction. Then, it is cut into a pipe with a desired length by a cutter (not shown).

FIG. 14 is a cross sectional view showing a detailed arrangement of LWC coiled around the bobbin in FIG. 13A or 13B. As shown in FIG. 14, the LWC 20 is structured with the copper pipe coiled around the bobbin 21. The bobbin 21 comprises an inner cylinder 23 around which the copper pipe 22 is coiled in multiple layers, and a pair of disk-like side boards 24 attached to both sides of the inner cylinder 23.

However, the copper pipe feeding apparatuses 10A, 10B as shown in FIGS. 13A and 13B have a problem that the structure is complicated and the cost thereof increases.

In order to solve this problem, JP-A-2002-370869 discloses a copper pipe feeding method called "Eye to the sky" (hereinafter called ETTS). The method "Eye to the sky" is also called as "Inner end payoff (ID payoff)".

FIG. 15 is a perspective view showing the method of feeding a copper pipe by the ETTS method. An LWC assembly 30 has plural LWC's 32 that are stacked through a cushioning material 33 such that its center axis is directed perpendicularly to the upper surface of a pallet 31. The pallet 31 is usually formed rectangular and comprises plural wooden square logs 31*a* and one or more wooden board 31*b* attached on the square logs 31*a*. The cushioning material 33 is formed of wood, paper or plastics and has a disk shape with a larger diameter than that of the LWC 32. The cushioning material 33 is often inserted between the pallet 31 and the LWC 32.

As shown in FIG. 15, the LWC 32 has an outside diameter of about 1000 mm and an inside diameter of 500 to 600 mm. The total height of the LWC assembly 30 including the pallet 31 is about 1 to 2 m.

The method of feeding a copper pipe by the ETTS method will be explained below referring to FIG. 15.

The copper pipe 35 is fed upward from the inside of the top LWC 32 in the LWC assembly 30. Then, in order to cut the copper pipe 35 on a pass line set horizontally about 1 m over the floor, the feeding direction is changed by a guide 34 disposed above the LWC assembly 30. Then, the copper pipe 35 is cut into a desired length by a cutter. A circular arc as the guide 34 is formed from a metal or plastic tube and has an inner diameter larger than an outer diameter of the copper pipe 35. The height from the plane on which to place the pallet 31 to the guide 34 is about 2.5 to 3.5 m. The cutter cuts the copper pipe on the pass line set horizontally about 1 m over the floor in a horizontal state. The ETTS method is a method in that the pipe is fed upward from the inside of the LWC disposed such that a coil center axis is perpendicular to a mounting surface of the pallet 31.

The ETTS method is advantageous in removing the purchase cost of the bobbin since the bobbin 21 shown in FIG. 14 is not needed. Further, as shown in FIG. 15, since it is not needed to rotate the LWC, the uncoiler and turntable as shown in FIGS. 13A and 13B are not needed, either. Thus, the facility cost can be significantly reduced.

A method of coiling the LWC 32 will be explained below referring to FIG. 14.

As shown in FIG. 14, for example, the copper pipe 22 is wound on the inner cylinder 23 of the bobbin 21 from a copper pipe 22*a* at start position to the right direction in alignment winding. The alignment winding is a method that the copper pipe 22 is wound in a circuit around the inner cylinder 23 and then it is wound in the next circuit in close contact with the previous circuit not to have a gap therebetween.

As shown in FIG. 14, after the copper pipe 22 is wound up to the right end to have a cylinder form as the first layer, the second layer is wound on the first layer in alignment winding along the center-axis direction of the LWC from the right end to the left end (in the reverse direction). At that time the copper pipe of the second layer is wound to be engaged in a concave portion formed between adjacent copper pipes in the first layer, namely, the copper pipe of the second layer is arrayed in close-packed alignment to that of the first layer. Further, the third layer coil is formed on the second layer coil in the same way. This is called traverse winding, where after the first-layer cylindrical coil is formed, the second-layer cylindrical coil is wound in the reverse direction along the center-axis direction of the LWC. By winding the copper pipe 22 as described above, the LWC can be reduced in volume and, therefore, a space needed in storing and transporting can be reduced.

FIG. 16 is a schematic cross sectional view illustrating an uncoiling method in LWC. FIG. 16 indicates the uncoiling state when the LWC 20 is uncoiled by the ETTS method, where the LWC 20 is produced such that the copper pipe 22 is wound around the bobbin 21 by the coiling method as shown in FIG. 14, removing the bobbin 21, disposing the LWC 20 on the cushioning material 33 as shown in FIG. 15. At first, the copper pipe 22*a* at start position on the inner layer side is fed upward. After the feeding of the first-layer is completed, the feeding of the second layer begins from a copper pipe 22*b* at lower end. Subsequently, the third layer adjoined outside of the second layer is fed from the upper end to the lower end.

However, the uncoiling method in LWC as shown in FIG. 16 has the next problems. When the LWC 20 is set as the LWC 32 in FIG. 15, for example, the copper pipe 22*b* at lower end of the second layer is sandwiched between the cushioning material 33 (or the pallet 31) and a copper pipe 22 lying directly thereon. Therefore, it may be difficult to feed the copper pipe 22*b* due to the friction. When the friction in feeding is increased, the copper pipe 22 may be subjected to a bend or kink, resulting in product failure. Further, copper pipes 22*b* at the lower end of even-numbered layers, i.e., the second and fourth layers etc can have the same problem.

In this regard, JP-A-2002-370869 (FIGS. 3 and 7) discloses an uncoiling method to facilitate the feeding of a copper pipe 22*b* at lower end in the ETTS method.

FIGS. 17 and 18 (corresponding to FIGS. 3 and 7, respectively, of JP-A-2002-370869) are schematic cross sectional views illustrating the uncoiling method to facilitate the feeding of a copper pipe at lower end.

One-side section of LWC 40 as shown in FIG. 17 is structured such that a copper pipe 41*a* at start position is located on the top, where an odd-numbered layer has n pipes (circuits) and an even-numbered layer has (n−1) pipes (circuits). The n is a natural number of 2 or more, typically 10 or more, and the pipes are wound in alignment winding.

In LWC 40 as shown in FIG. 17, the LWC 40 is fed upward from the inside of the LWC, for example, the copper pipe 41*a* at start position on the inner layer side is fed upward, and the copper pipe at lower level is successively fed for every one circuit. After the feeding of a lowermost level of the first-layer is completed, the feeding of the second layer begins from a copper pipe 41*b* at lower end. In this case, since a gap exists between the copper pipe 41*b* at lower end of the second layer and the cushioning material 33 or pallet 31, the copper pipe 41*b* is less likely to be subjected to the resistance of the friction. Thus, the copper pipe 41 can be fed stably.

In contrast, FIG. 18 shows one-side section of LWC 40 that a copper pipe 41*a* at start position (at a starting section for winding) is located at the bottom close to the cushioning material 33. The copper pipe 41*a* at start position on the inner layer side is fed upward from the lower end to the upper end. As shown in FIG. 18, an odd-numbered layer has n pipes (circuits) and an even-numbered layer also has n pipes (circuits). After the feeding of the first-layer is completed, the feeding of the second layer begins from a copper pipe 41 at the upper end. In this case, since a copper pipe 41 at lower end of the second layer is not sandwiched when the copper pipe 41 turns upward, the copper pipe 41 can be fed stably as well as the case in FIG. 17.

Meanwhile, the above is taught in paragraphs [0009] to [0012] [0014] to [0017], [0039], [0042], [0062], and [0063] and FIGS. 3, 7 and 14 of JP-A-2002-370869.

However, the conventional uncoiling method of JP-A-2002-370869 has the next problem. In the LWC wound as shown in FIG. 17, a connection from the copper pipe 41 at lower end of the first layer to the copper pipe 41*b* at lower end of the second layer is exactly formed of a continuous copper pipe, though seen as separate pipes in the cross sectional view of FIG. 17. Thus, the copper pipe 41 is continuously shifted outward and upward in a shift (transition) section on the circuit. The shift section exists in a predetermined part on the circumference at an outer layer side in a radius direction of the coil and upward in the coil center axis direction. When the length of a transition part moving to an outer layer side in a coil radius direction of the shift section increases, namely, a start of moving upward to a perpendicular direction is late, the gap under the copper pipe 41 may substantially disappear. Namely, the copper pipe 41*b* at lower end may be sandwiched between the cushioning material 33 or the pallet 31 and the copper pipe 41 lying directly thereon. Therefore, it may be difficult to feed the copper pipe 41 and the copper pipe 41 may be subjected to a bend (kink and/or plastic buckling).

The shift section that the copper pipe is shifted to the next-layer (i.e., the outer layer) will be explained later.

SUMMARY OF THE INVENTION

It is an object of the invention to provide an LWC that can avoid the pipe trapping at the shift section when feeding a copper pipe from the LWC by using the ETTS method.

It is a further object of the invention to provide a method of manufacturing the LWC.

It is a further object of the invention to provide a package for the LWC.

As the results of analyzing the ETTS method by the inventors, it is found that the pipe trapping in the ETTS method is caused by the location and the length of the shift section (i.e., the location thereof at the bottom surface of the LWC, and the location of a stack column in a vertical section at the shift section). Based on this finding, the inventors have completed the invention as described below.

According to a first feature of the invention, a method of manufacturing a level wound coil (LWC) comprises the steps of:

providing a plurality of coil layers each of which comprises a pipe wound in alignment winding and in traverse winding;

locating a coil of a (m+1)-th coil layer such that a pipe at start position thereof is fitted into a concave part formed outside of the m-th coil layer and between a pipe at a lower end and its adjacent pipe of a m-th coil layer, where, when the LWC is disposed on a mount surface perpendicular to a coil center axis of the LWC, m is an odd natural number if a start position of the winding of the LWC is located at the upper end and m is an even natural number if the start position is located at the lower end;

locating a shift section where the pipe is shifted from the m-th coil layer to the (m+1)-th coil layer on a bottom surface thereof when the LWC is disposed on the mount surface perpendicular to the coil center axis;

locating a part or a total of a start point of the (k+1)-th shift section on outer layer side not to transit, relative to a start point of the k-th shift section on inner layer side, to a direction reverse to a winding direction of the pipe, and controlling a length of the shift section that does not transit to the reverse direction when the pipe is shifted until the pipe at the start position of the (m+1)-th coil layer is fitted into the concave part formed outside of the m-th coil layer.

(a) The shift section that does not transit to the reverse direction may comprise an axis-direction non-shift section that is not shifted to a direction of the coil center axis, and a length ($L_{NA}$) of the axis-direction non-shift section is controlled in the step of controlling the length of the shift section that does not transit to the reverse direction.

(b) The length ($L_{NA}$) of the axis-direction non-shift section is controlled to satisfy a following equation:

$$L_{NA} \leq \frac{Z\sigma_B(\Delta C_{max}d)^{1/3}}{\rho_L g\{\mu_{ts}(1.5n^* - 0.5) + 1.5\mu_{tt}(n^* - 1)\}R_{out}^{1/4}R^{3/4}} = L_{max}$$

wherein:

$L_{NA}$: length of axis-direction non-shift section of shift section [m], $\rho_L$: mass of pipe per unit length [kg/m], g: gravity acceleration [M/s$^2$], $\mu_{ts}$: coefficient of friction between pipe and coil spacer, $\mu_{tt}$: coefficient of friction between adjacent pipes, n*: winding number of one coil layer in LWC (When the winding number is varied in different layers, n* is the largest number.), $R_{out}$: curvature radius of pipe in outermost layer of LWC [m], R: curvature radius of copper pipe bent in feeding part [m], Z: section modulus [m$^3$], $\sigma_B$: tensile strength [Pa], $\Delta C_{max}$: maximum curvature difference that does not cause plastic buckling of circular pipe [m$^{-1}$], and d: outer diameter of pipe [m].

According to a second feature of the invention, a LWC comprises:

a plurality of coil layers each of which comprises a pipe wound in alignment winding and in traverse winding, a coil of a (m+1)-th coil layer being located such that a pipe at start position thereof is fitted into a concave part formed outside of the m-th coil layer and between a pipe at a lower end and its adjacent pipe of a m-th coil layer, where, when the LWC is disposed on a mount surface perpendicular to a coil center axis of the LWC, m is an odd natural number if a start position of the winding of the LWC is located at the upper end and m is an even natural number if the start position is located at the lower end, wherein the LWC comprises a shift section where the pipe is shifted from the math coil layer to the (m+1)-th coil layer on a bottom surface thereof when the LWC is disposed on the mount surface perpendicular to the coil center axis, the shift section comprises a k-th shift section on inner layer side and a (k+1)-th shift section on outer layer side, where a part or a total of a start point of the (k+1)-th shift section does not transit, relative to a start point of the k-th shift section, to a direction reverse to a winding direction of the pipe, and a length of the shift section that does not transit to the reverse direction is adjusted when the pipe is shifted until the pipe at the start position of the (m+1)-th coil layer is fitted into the concave part formed outside of the m-th coil layer.

(a) The shift section that does not transit to the reverse direction may comprise an axis-direction non-shift section that is not shifted to a direction of the coil center axis, and a length ($L_{NA}$) of the axis-direction non-shift section is controlled in the step of controlling the length of the shift section that does not transit to the reverse direction.

(b) The length ($L_{NA}$) of the axis-direction non-shift section is controlled to satisfy a following equation:

$$L_{NA} \leq \frac{Z\sigma_B(\Delta C_{max}d)^{1/3}}{\rho_L g\{\mu_{ts}(1.5n^* - 0.5) + 1.5\mu_{tt}(n^* - 1)\}R_{out}^{1/4}R^{3/4}} = L_{max}$$

wherein:

$L_{NA}$: length of axis-direction non-shift section of shift section [m], $\rho_L$: mass of pipe per unit length [kg/m], g: gravity acceleration [m/s$^2$], $\mu_{cs}$: coefficient of friction between pipe and coil spacer, $\mu_{tt}$: coefficient of friction between adjacent pipes, n*: winding number of one coil layer in LWC (When the winding number is varied in different layers, n* is the largest number.), $R_{out}$: curvature radius of pipe in outermost layer of LWC [m], R: curvature radius of copper pipe bent in feeding part [t], Z: section modulus [m$^3$], $\sigma_B$: tensile strength [Pa], $\Delta C_{max}$: maximum curvature difference that does not cause plastic buckling of circular pipe [m$^{-1}$], and d: outer diameter of pipe [m].

According to a third feature of the invention, a package for LWC, comprises:

a pallet comprising a mount surface;

the LWC according to the second feature of the invention, the LWC being disposed in single or stacked in plurality through a cushioning material on the mount surface perpendicular to the coil center axis of the LWC;

an envelope for wrapping a total of the LWC; and a strip resin film provided on a side of the envelope in tension winding.

Herein, "a start point of a shift section" means a start point of a shift section where a wound pipe is shifted from a m-th layer to a (m+1)-th layer, i.e., a point from where a pipe at lower end of the m-th layer starts shifting outward in the radius direction of an LWC. Further, "an end point of a shift section" means an end point of a shift section where a wound pipe is shifted from a m-th layer to a (m+1)-th layer, i.e., a point where a pipe at lower end of the (m+1)-th layer is fitted into a concave part formed outside between stacked pipes of the m-th layer.

Herein, "a winding direction of a pipe" means a winding direction defined when a pipe is wound around a bobbin etc. When the pipe is wound around there by rotating the bobbin, the winding direction is defined as the reverse direction to the rotation direction of the bobbin.

Further, herein, "not transiting to a reverse direction" means a state that it transits in the forward direction to a winding direction or that it does not transit in the forward nor reverse direction.

Herein, a "shift section" is generally defined as the sum of an "axis-direction non-shift section" that a pipe is not shifted in the center-axis direction of an LWC (i.e., the axis-direction non-shift section includes (a) a part shifted only in the radius direction of an LWC and (b) a part not shifted in the radius direction nor the axis direction of the LWC), and an "axis-direction shift section" that the pipe is shifted in the center-axis direction of the LWC. Of the "shift section", the "axis-direction non-shift section" is likely to be sandwiched between a pipe lying directly thereon and the coil spacer (or cushioning material) so that a kink or bend may happen thereat during the feeding of the copper pipe. Meanwhile, as described earlier, the copper pipe is shifted at least outward in the coil radius direction at the start point of the "shift section".

Herein, terms for LWC are defined as follows. Viewing from the center axis of an LWC, stacked copper pipes in a concentric fashion is called "layer". From the center (=coil center axis) toward the centrifugal direction, they are numbered first layer, second layer . . . . In a layer of LWC, the number of coil circuits is called "winding number". It is also called "step number" especially when the coil center axis is disposed in the vertical direction, e.g., when the copper pipe is fed. When the coil center axis is disposed in the vertical direction, e.g., when the copper pipe is fed, a lower surface of LWC in the vertical direction to be contacted with the coil spacer (or pallet) is called "coil lower surface (lower end)" or "coil bottom", and an upper surface of LWC in the vertical direction is called "coil upper surface (upper end)". A portion shifted from m-th layer to (m+1)-th layer is called "shift section". When the coil center axis is disposed in the vertical direction, e.g., when the copper pipe is fed, the shift sections arranged at the coil lower surface are numbered k-th, (k+1)-th, . . . (from the inner side toward the outer side), where the coil pipes at the coil upper surface are not considered.

According to the present invention, it is possible to provide a LWC and a package for a LWC, in which the troubles such as the pipe trapping can be prevented, when the copper pipe is fed from the lowermost stage with the shift section of the coil in the ETTS method.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First to Third Embodiments

Construction of LWC

Figure 1:
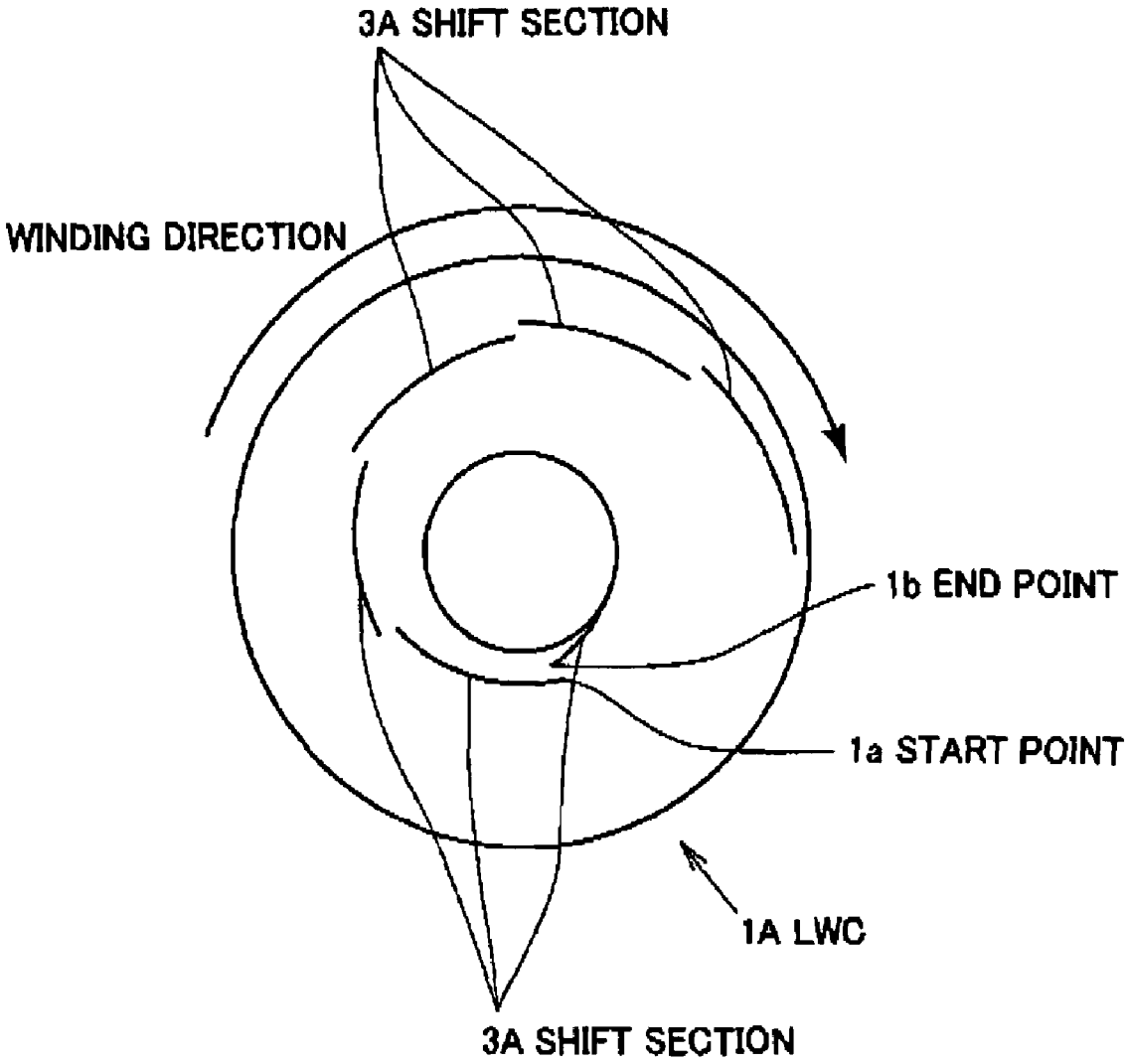
FIG. 1 is a schematic bottom view showing an LWC in a first preferred embodiment according to the invention.
Figure 2:
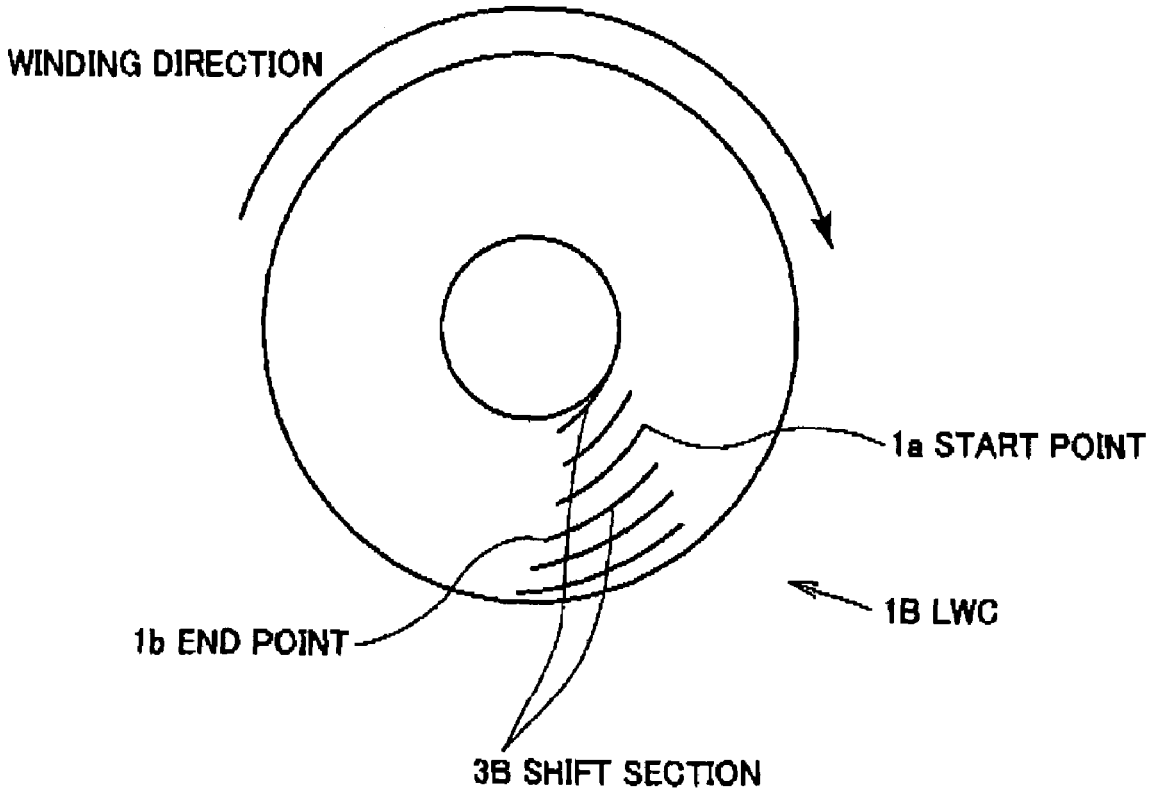
FIG. 2 is a schematic bottom view showing an LWC in a second preferred embodiment according to the invention.
Figure 3:
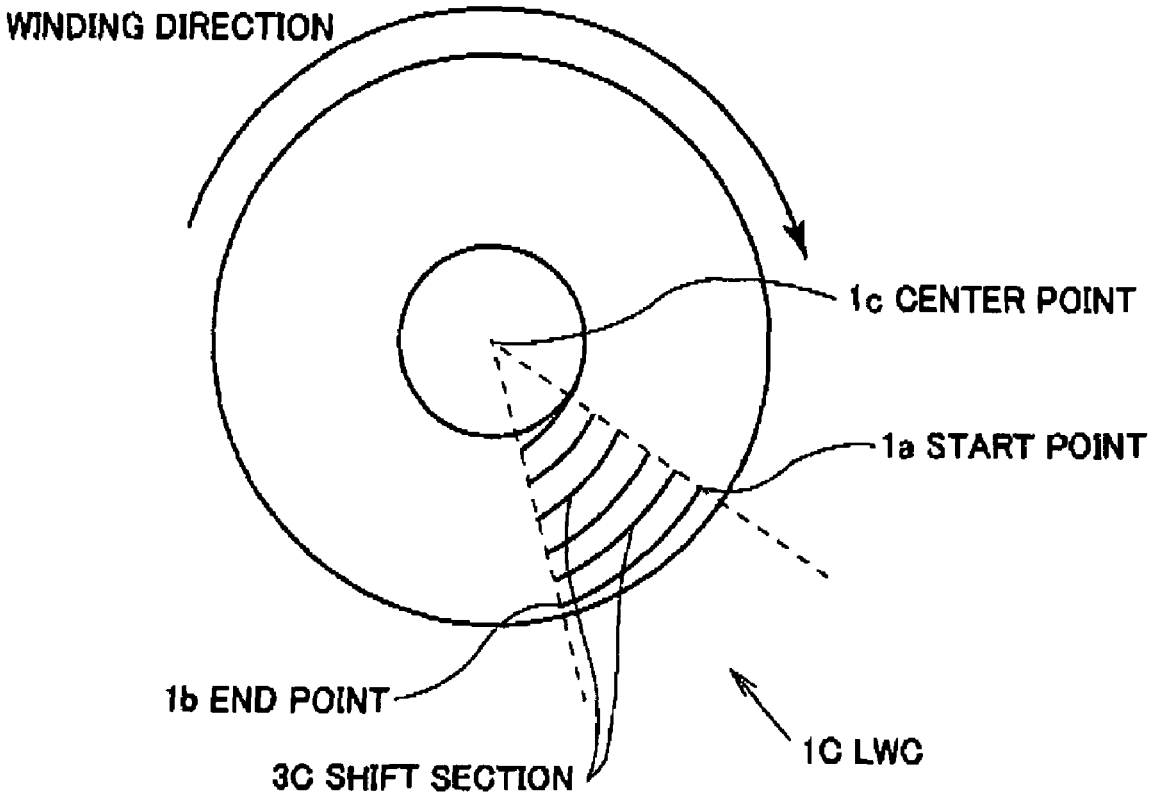
FIG. 3 is a schematic bottom view showing an LWC in a third preferred embodiment according to the invention.

FIGS. 1 to 3 are schematic bottom views showing LWC's in the first to third preferred embodiment according to the invention.

In FIGS. 1 to 3, in order to simplify the explanation, the shape of copper pipes is not illustrated and only the location of shift sections 3A to 3C in LWC's 1A to 1C is illustrated.

The LWC's of the embodiments are structured in the same manner as that of JP-A-2002-370869. However, they are different from the latter in that a location of the shift section on the coil lower surface is determined and a length thereof is controlled.

It is desired that the coil layers are as a whole odd layers (with the outermost layer being odd-numbered), and that the pipe is wound until an axis-direction non-shift section of a shift section at a lower end of the outermost layer, when the winding start position is located at the top. It is preferable that the coil layers are even layers (with the outermost layer being even-numbered) as a whole, and that the winding number of the outermost layer is not greater than 5. Further, it is desired that the coil layers are as a whole even layers (with the outermost layer being even-numbered) and that the pipe is wound until an axis-direction non-shift section of a shift section at a lower end of the outermost layer, when the winding start position is located at the bottom. It is preferable that the coil layers are odd layers (with the outermost layer being odd-numbered) as a whole, and that the winding number of the outermost layer is not greater than 5.

The LWC's in JP-A-2002-370869 are structured as any of:

(a) an LWC that (i) the coil axis direction is disposed vertically with the winding start position being at the top and the coil is uncoiled from the inside, (ii) the first layer coil is formed by winding the pipe in alignment winding, subsequently the second layer coil is formed by winding the pipe in alignment winding on the first layer coil while being fitted into a concave part formed outside between stacked pipes of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of (n−1), and (iv) the stack direction in vertical section is reversed each other between the odd-numbered layer coil and the even-numbered layer coil;

(b) an LWC that (i) the coil axis direction is disposed vertically with the winding start position being at the bottom and the coil is uncoiled from the inside, (ii) the first layer coil is formed by winding the pipe in alignment winding, subsequently the second layer coil is formed by winding the pipe in alignment winding on the first layer coil while being disposed into a concave part (or a part adjacent to there) formed outside between stacked pipes of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of (n+1), and (iv) the stack direction in vertical section is reversed each other between the odd-numbered layer coil and the even-numbered layer coil; and (c) an LWC that (i) the coil axis direction is disposed vertically and the coil is uncoiled from the inside, (ii) the first layer coil is formed by winding, the pipe in alignment winding, subsequently the second layer coil is formed by winding the pipe in alignment winding on the first layer coil while being disposed into a concave part (or outside thereof) formed outside between stacked pipes of the first layer coil such that the pipe at start position of the second layer is fitted into a concave part formed between the pipe at lower/upper end and its adjacent pipe of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of n, and (iv) the stack direction in vertical section is reversed each other between the odd-numbered layer coil and the even-numbered layer coil.

FIGS. 1 and 2 (corresponding to the first and second embodiments, respectively) are schematic bottom views showing examples that a start point 1*a* of a (k+1)-th shift section (on outer-layer side) transits, in a forward direction (i.e., clockwise) to the winding direction (i.e., clockwise) of the copper pipe, relative to a start point 1*a* of a k-th shift section (on inner-layer side). In these examples, the shift section transits in the forward direction (i.e., clockwise) to the winding direction (i.e., clockwise) of the copper pipe. Naturally, the shift section may transit in the forward direction (i.e., counterclockwise) to the winding direction (i.e., counterclockwise) of the copper pipe.

On the other hand, FIG. 3 (=the third preferred embodiment according to the invention) is a schematic bottom view showing an example that the start point 1*a* of the (k+1)-th shift section (on outer-layer side) does not transit, in a forward or reverse direction to the winding direction of the copper pipe, relative to the start point 1*a* of the k-th shift section (on inner-layer side).

As shown in FIG. 3, the LWC 1C is constructed such that the k-th shift section 3C (on inner-layer side) and the (k+1)-th shift section 3C (on outer-layer side) transit lying on a same radius on the bottom surface of the LWC 1C. Further, all the shift sections 3C are within a fan-shaped sector region that is formed connecting between a center point 1*c* on the bottom surface of the LWC 1C and the start point 1*a* and end point 1*b* of the outermost shift section 3C.

The LWC according to the present invention may be construed to have a locative arrangement of the shift sections in which the embodiment shown in FIG. 1 (or FIG. 2) is combined with the embodiment shown in FIG. 3, i.e. the first (or the second) embodiment is combined with the third embodiment. In other words, there may be both the shift sections transiting in the forward direction to the winding direction of the copper pipe and the shift sections that do not transit in the forward nor reverse direction to the winding direction of the copper pipe. The present invention also includes the LWC in which all the shift sections are located as described above as well as the LWC in which a part of the shift sections transits in the reverse direction.

It is necessary to conduct a step of controlling a length of the shift section, concerning the shift section transiting in the forward direction to the winding direction of the copper pipe and the shift section that does not transit in the forward nor reverse direction to the winding direction of the copper pipe.

Method of Manufacturing LWC

The LWC in the preferred embodiments according to the present invention can be fabricated by the conventional method, for example, the method described in JP-A-2002-370869 (e.g. paragraph [0039]). However, the LWC in the present invention is different from the conventional method in that the location and the length of the shift section at the lower surface is controlled by changing the winding manner of the pipe shifting from the m-th coil layer (on the inner-layer side) to the (m+1)-th coil layer (on the outer-layer side).

The method of controlling the location of the shift sections is not limited to a particular method. For example, it is possible to control the location of the shift section by winding the pipe around a bobbin such that the shift section of the pipe transits in the forward direction to the winding direction of the copper pipe, in the manner that a timing of shifting the pipe on the m-th coil layer (on the inner-layer side) to the (m+1)-th coil layer (on the outer-layer side) is delayed, i.e. the start point of the axis-direction shift section is delayed in winding at a return portion of the traverse winding to define the bottom surface of the LWC. The start point of the (k+1)-th shift section (on the outer-layer side) is located in the forward direction to the winding direction beforehand a vertical section including the coil center axis (located on the same side when viewing front the coil center axis) where the start point of the k-th shift section (on the inner-layer side) is located, so that the locations of the shift sections shown in FIGS. 1 and 2 can be realized.

The location of the shift section as shown in FIG. 3 can be obtained by winding such that the start points of both the (k+1)-th shift section (on the outer-layer side) and the k-th shift section (on the inner-layer side) are located on the same vertical section (located on the same side when viewing from the coil center axis) including the coil center axis, and the end points of both the (k+1)-th shift section (on the outer-layer side) and the k-th shift section (on the inner-layer side) are located on the same vertical section (located on the same side when viewing from the coil center axis, and different from that including the start point) including the coil center axis.

Process of Forming Shift Section

The process of forming the shift section will be described below.

FIGS. 4A to 4E are schematic perspective views showing a process of forming a shift section in an LWC.

Figure 4A:
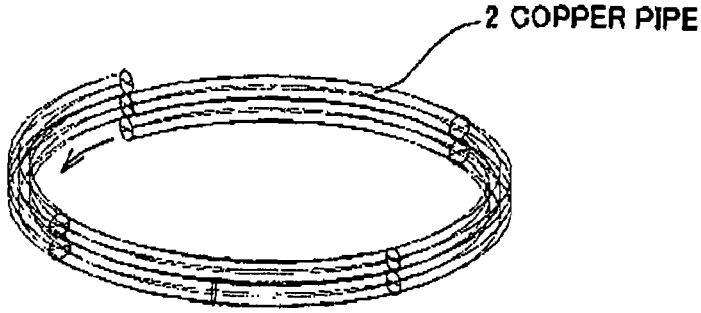
FIGS. 4A to 4E are schematic perspective views showing a process of forming a shift section in an LWC.
Figure 4B:
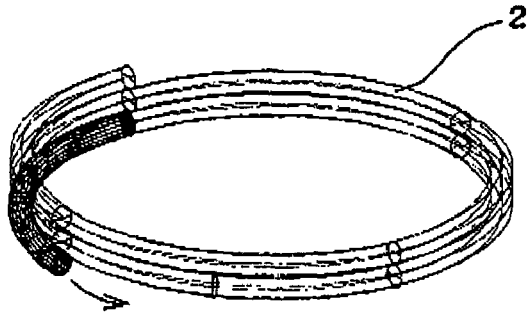
Figure 4C:
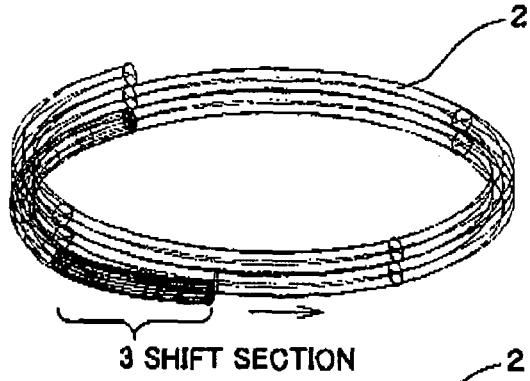
Figure 4D:
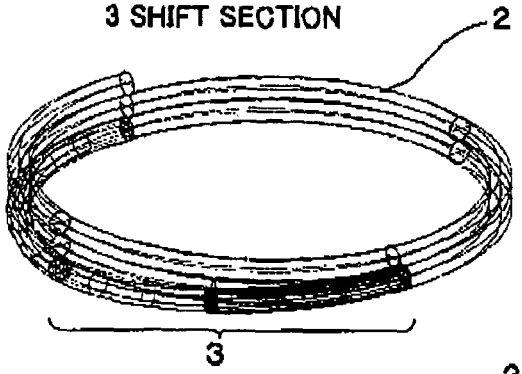
Figure 4E:
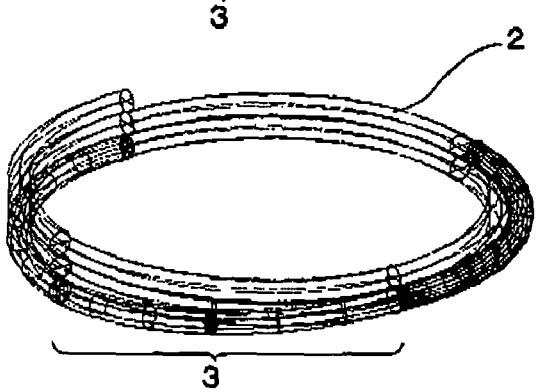

At the bottom side of each of FIGS. 4A to 4E, a copper pipe at lower end in a certain layer in the LWC is shown. When the copper pipe is wound up to the lower end (FIGS. 4A and 4B), a shift section 3 appears in shifting to the next layer (the outer layer) (FIG. 4C), and then the copper pipe is shifted to the next layer while further forming the shift section 3 (FIGS. 4D and 4E). In FIGS. 4A to 4E, for simplification in explanation, the pipe (coil) is shown helical-wound (i.e. in spiral winding).

Relationship Between Pipe Winding Method and Configuration of Shift Section

Referring to FIGS. 5 to 10, the relationship between the pipe winding method and the configuration of shift section will be explained below. Although a start point of a shift section is shown in FIGS. 5 to 10, a real start point is located at just after the start point as shown.

Figure 5:
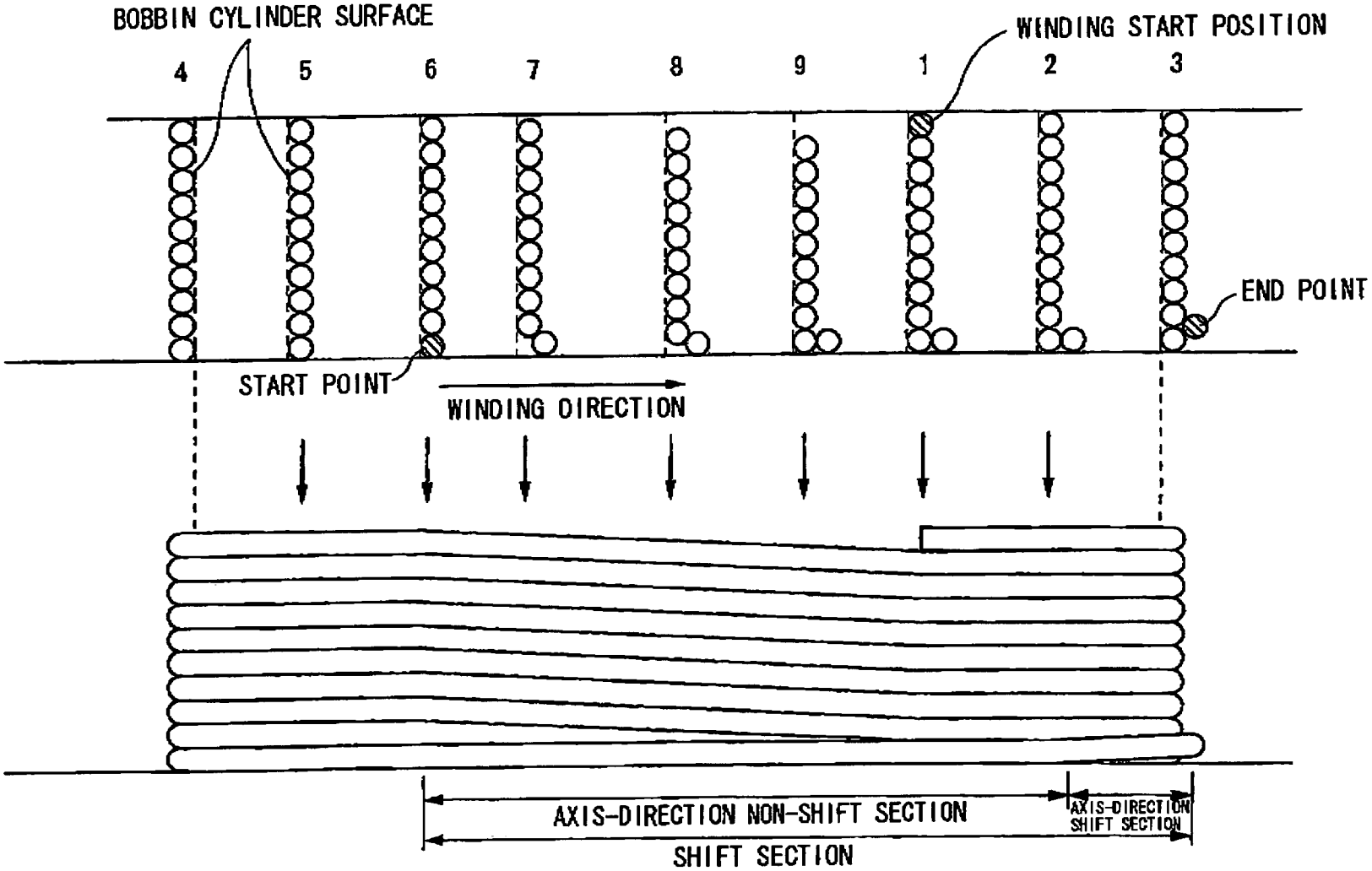
FIG. 5 is a schematic side view of LWC (below) and a schematic vertical cross sectional view of LWC (above) at each position (Nos. 1-9) as indicated by a downward arrow showing a shift section from a first layer to a second layer in an example winding method, where a start point of a (k+1)-th shift section (on outer-layer side) transits, in a forward direction to the winding direction of a copper pipe, relative to a start point of a k-th shift section (on inner-layer side)
Figure 6:
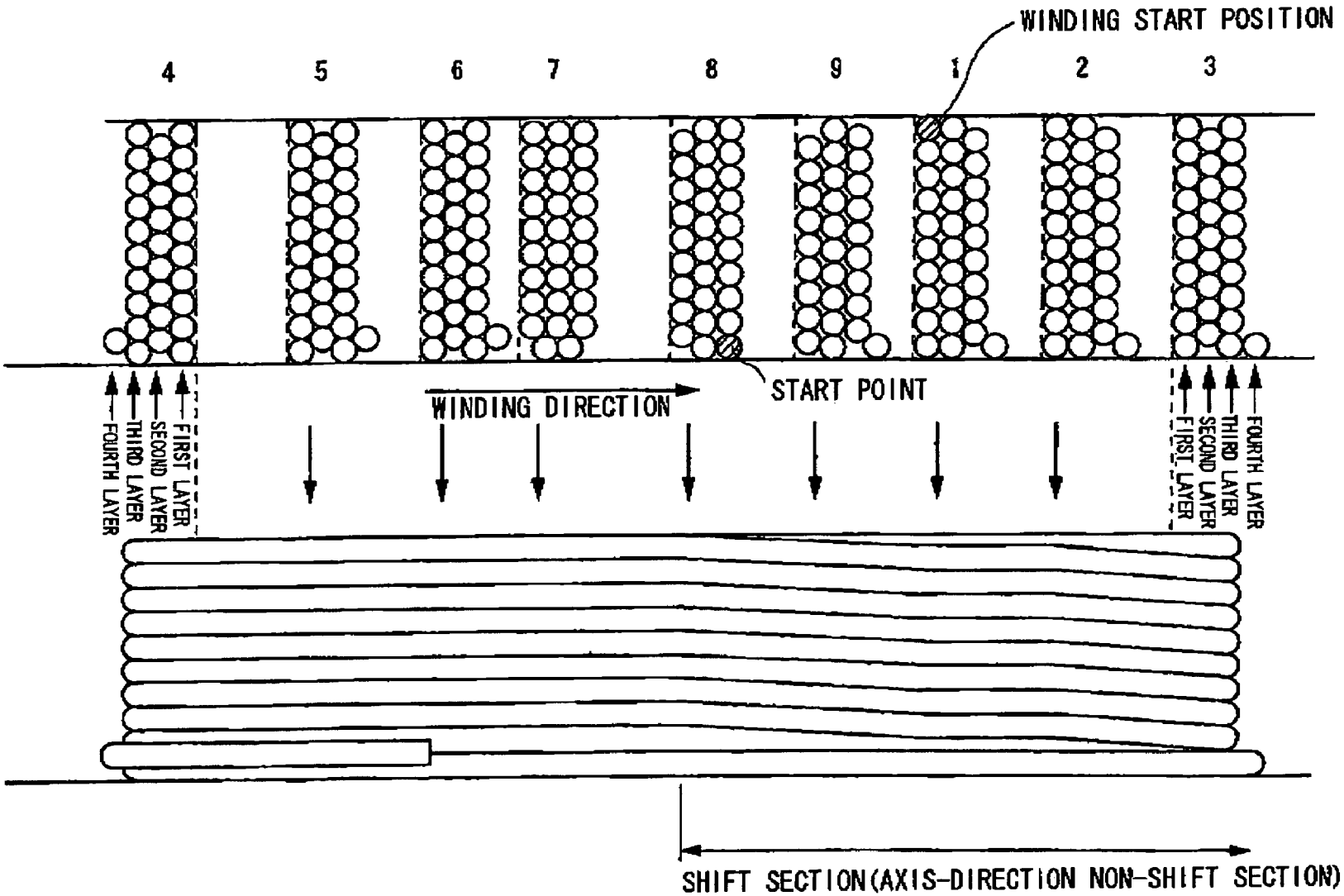
FIG. 6 is a schematic side view of LWC (below) and a schematic vertical cross sectional view of LWC (above) at each position (Nos. 1-9) as indicated by a downward arrow showing a shift section from a third layer to a fourth layer in the example winding method in FIG. 5.

FIGS. 5 and 6 show an example winding method, where a start point of a (k+1)-th shift section (on the outer-layer side) transits, in a forward direction to the winding direction of a copper pipe, relative to a start point of a k-th shift section (on the inner-layer side).

FIG. 5 is a schematic side view of LWC (below) and a schematic vertical cross sectional view of LWC (above) at each position (Nos. 1-9) as indicated by a downward arrow showing a shift section (and a transition region before and/or after there) from the first layer to the second layer. Meanwhile, the start point and end point of a shift section are also referred to as start position and end position with respect to FIGS. 5 to 10.

FIG. 6 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that, as compared to the position (i.e., from the start position 6 to the end position 3) of the shift section as shown in FIG. 5, the position (i.e., from the start position 8 to an end position located behind) of the shift section as shown in FIG. 6 is delayed more than one circuit. According to this method, the LWC as shown in FIGS. 1 and 2 can be formed. According to this winding method, the pipe can be easily wound for fabricating the ETTS type LWC. However, it is found in FIGS. 5 and 6 that its axis-direction non-shift section (a section being sandwiched between a copper pipe and a mount surface) in the shift section is so long that the pipe is likely to be trapped. Therefore, the process of controlling the length of the shift section is indispensable.

Figure 7:
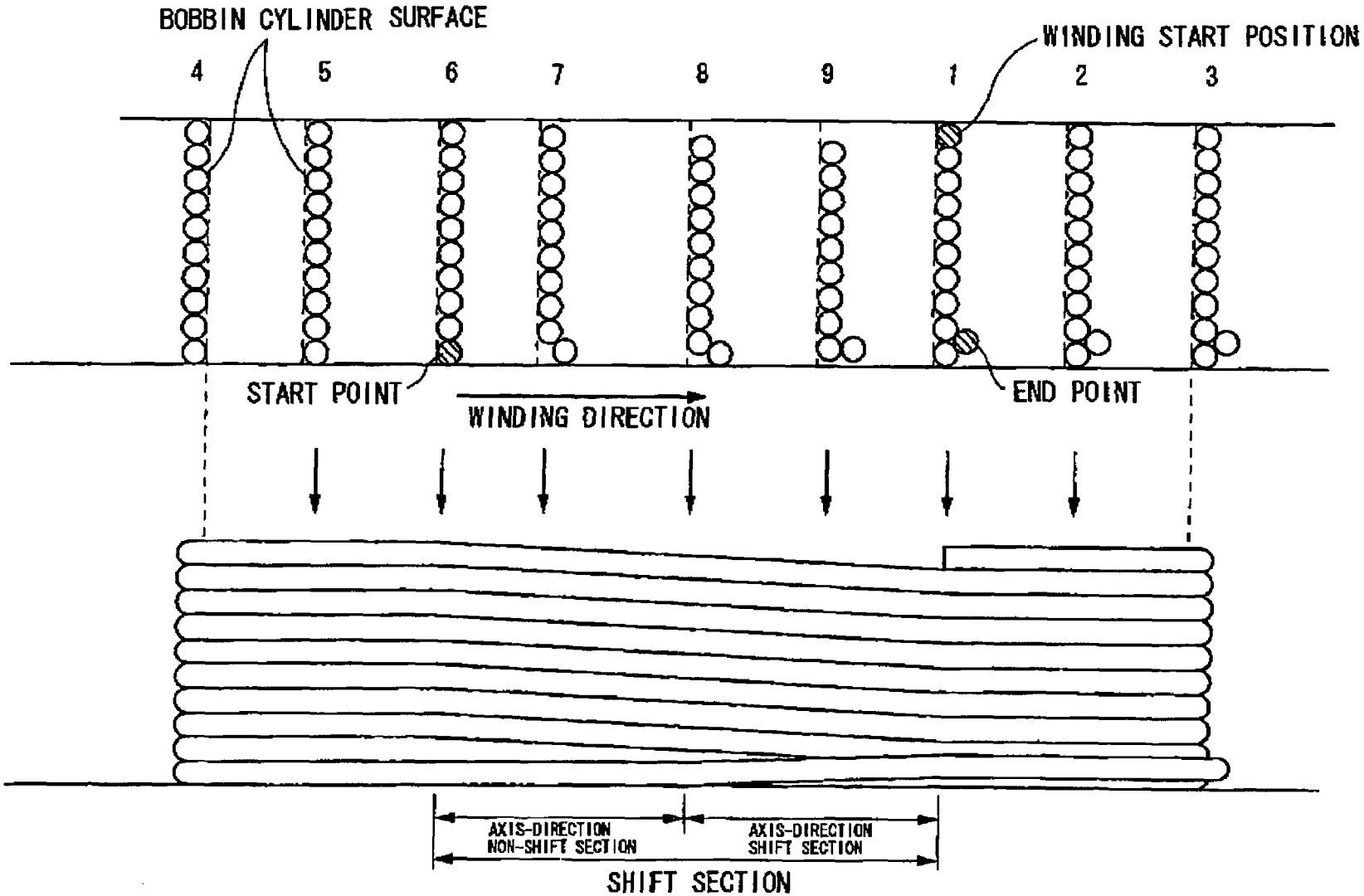
FIG. 7 is a schematic side view of LWC (below) and a schematic vertical cross sectional view of LWC (above) at each position (Nos. 1-9) as indicated by a downward arrow showing a shift section from a first layer to a second layer in another example winding method, where a start point of a (k+1)-th shift section (on outer-layer side) does not transit, in a forward or reverse direction to the winding direction of a copper pipe, relative to a start point of a k-th shift section (on inner-layer side)
Figure 8:
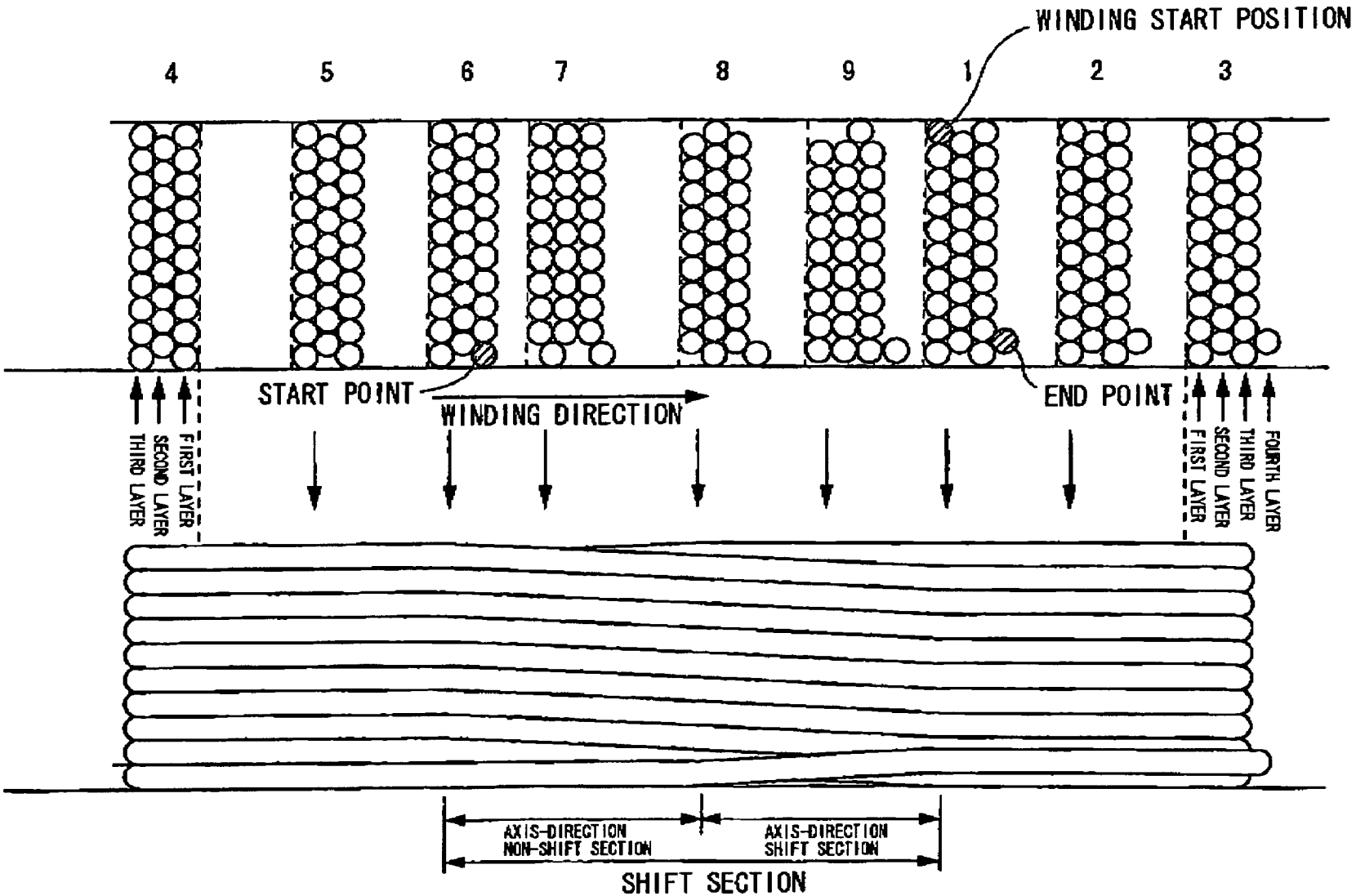
FIG. 8 is a schematic side view of LWC (below) and a schematic vertical cross sectional view of LWC (above) at each position (Nos. 1-9) as indicated by a downward arrow showing a shift section from a third layer to a fourth layer in the example winding method in FIG. 7.

FIGS. 7 and 8 show another example winding method, where a start point of a (k+1)-th shift section (on the outer-layer side) does not transit, in a forward nor reverse direction to the winding direction of a copper pipe, relative to a start point of a k-th shift section (on the inner-layer side).

FIG. 7 is a schematic side view of LWC (below) and a schematic vertical cross sectional view of LWC (above) at each position (Nos. 1-9) as indicated by a downward arrow showing a shift section (and a transition region before and/or after there) from the first layer to the second layer.

FIG. 8 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that the position (i.e., from the start position 6 to the end position 1) of the shift section as shown in FIG. 7 is located at substantially the same position as the position (i.e., from the start position 6 to the end position 1) of the shift section as shown in FIG. 8. The LWC as shown in FIG. 3 can be formed according to this method.

Further, it is found in FIGS. 7 and 8 that its axis-direction non-shift section (a section being sandwiched between a copper pipe and a mount surface) of the shift section is shorter than that in FIGS. 5 and 6 so that the pipe is less likely to be trapped. However, it is preferable to conduct the step of controlling the length of the shift section.

Figure 9:
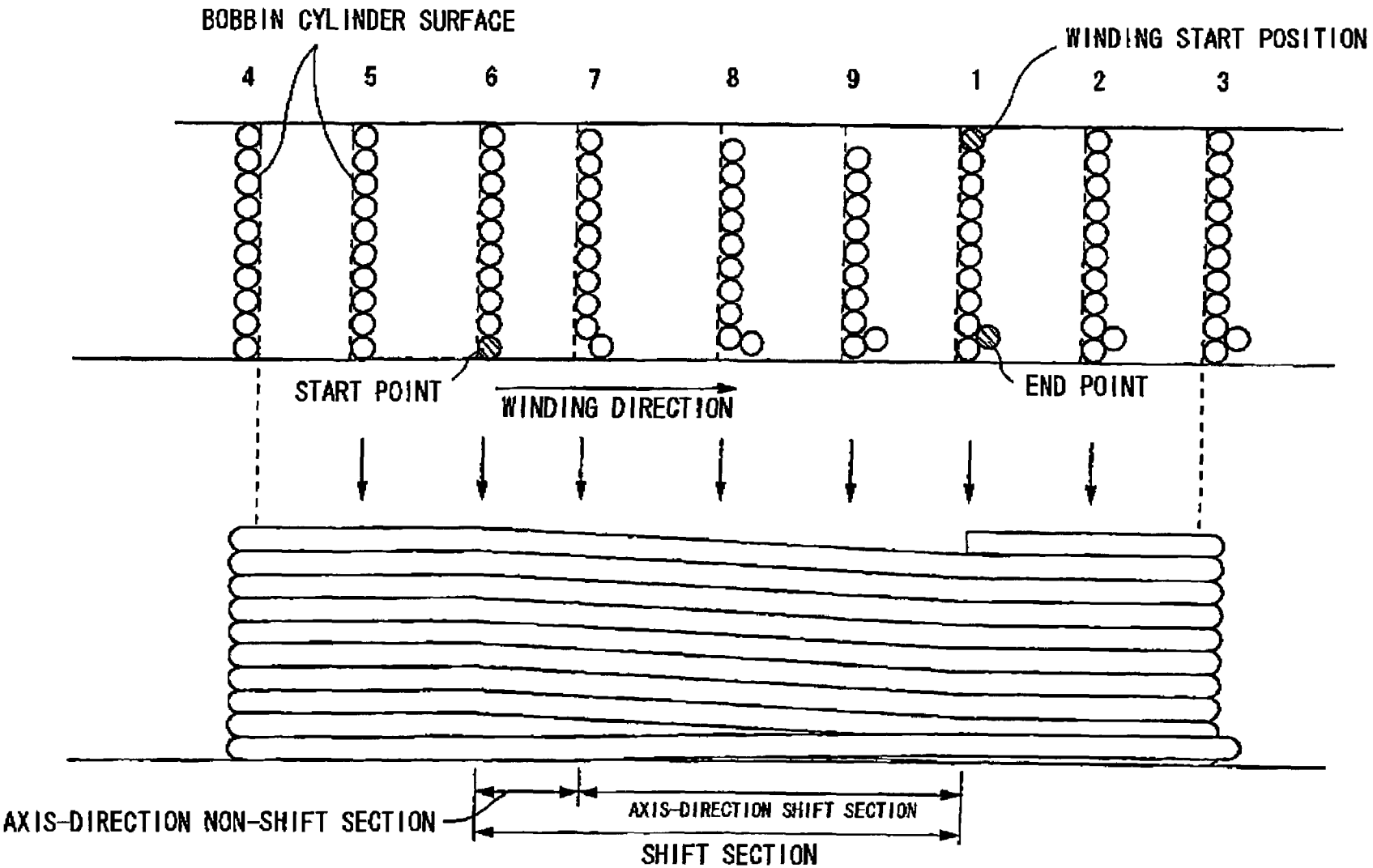
FIG. 9 is a schematic side view of LWC (below) and a schematic vertical cross sectional view of LWC (above) at each position (Nos. 1-9) as indicated by a downward arrow showing a shift section from a first layer to a second layer in a comparative-example winding method, where a start point of a (k+1)-th shift section (on outer-layer side) transits, in a reverse direction to the winding direction of a copper pipe, relative to a start point of a k-th shift section (on inner-layer side)
Figure 10:
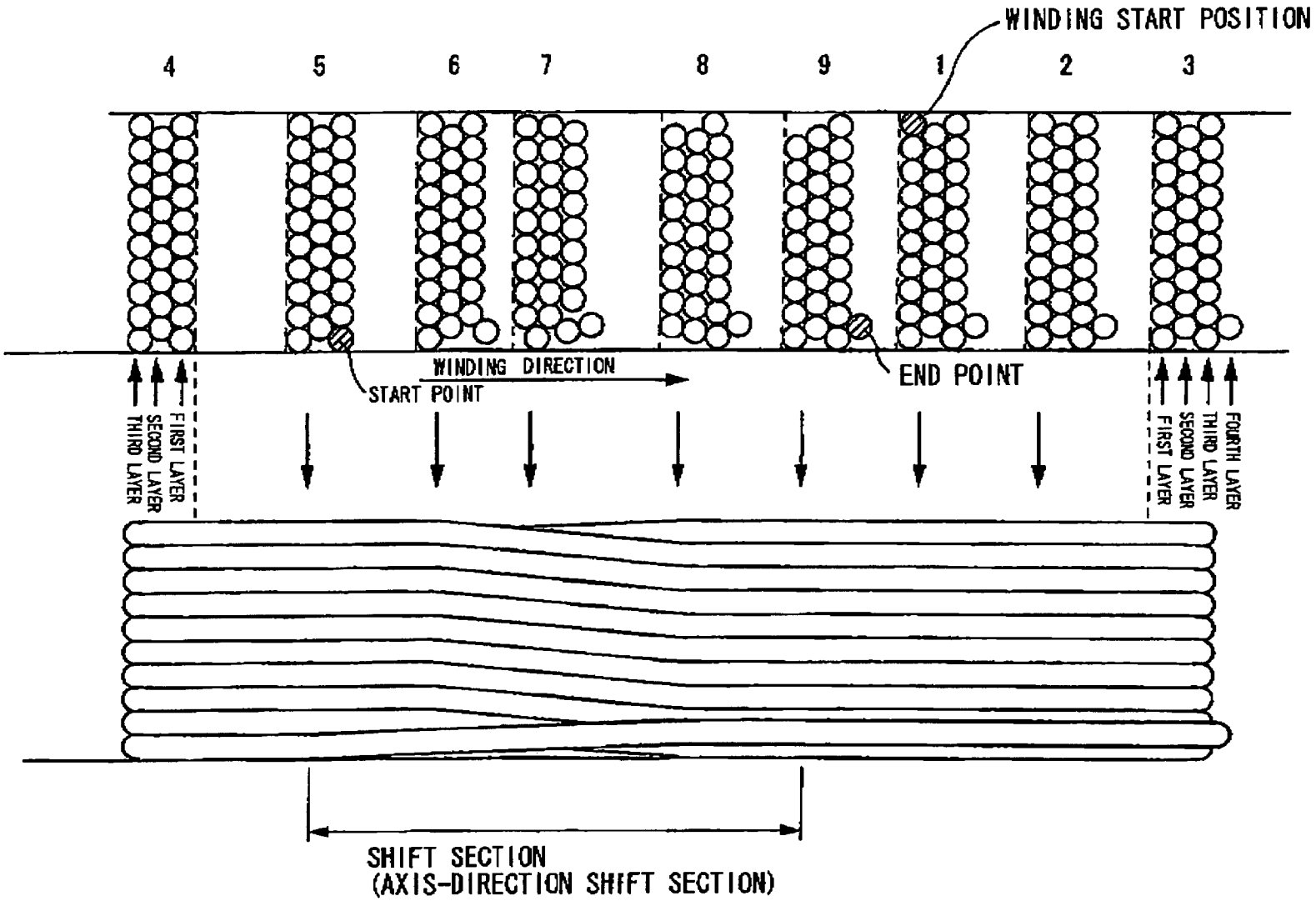
FIG. 10 is a schematic side view of LWC (below) and a schematic vertical cross sectional view of LWC (above) at each position (Nos. 1-9) as indicated by a downward arrow showing a shift section from a third layer to a fourth layer in the comparative-example winding method in FIG. 9.

FIGS. 9 and 10 show a comparative-example winding method, where a start point of a (k+1)-th shift section (on the outer-layer side) transits, in a reverse direction to the winding direction of a copper pipe, relative to a start point of a k-th shift section (on the inner-layer side).

FIG. 9 is a schematic side view of LWC (below) and a schematic vertical cross sectional view of LWC (above) at each position (Nos. 1-9) as indicated by a downward arrow showing a shift section (and a transition region before and/or after there) from the first layer to the second layer.

FIG. 10 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that, as compared to the position (i.e., from the start position 6 to the end position 1) of the shift section as shown in FIG. 9, the position (i.e., from the start position 5 to the end position 9) of the shift section as shown in FIG. 10 is advanced one circuit. Further, it is found in FIGS. 9 and 10 that its axis-direction non-shift section (a section being sandwiched between a copper pipe and a mount surface) of the shift section is shorter (nearly disappeared) than those in FIGS. 7 and 8, so that the pipe is less likely to be trapped. Accordingly, it is not necessary to conduct the step of controlling the length of the shift section that will be described later.

Next, a step of controlling (adjusting) a length of a shift section will be explained below.

A method of manufacturing the LWC in the preferred embodiments of the present invention comprises a step of controlling a length of a shift section that does not transit in a reverse direction in a process of shifting a pipe until a start point end of the (m+1)-th layer is fitted into a concave part formed outside between stacked pipes of the m-th layer.

In particular, the step of controlling the length of the shift section comprises a step of controlling a length ($L_{NA}$) of an axis-direction non-shift section that does not shift in a coil center axis direction in a shift section that does not transit in a reverse direction. The length (LNA) of the axis-direction non-shift section is controlled based on factors such as a step number of the copper pipe (winding number n in a height direction of the LWC), a curvature radius of the copper pipe in the LWC, and the like.

Process of Controlling Length of Shift Section

Next, the process of controlling the length of the shift section will be explained in more detail.

In the LWC manufactured by using the ETTS method, a force required for feeding a copper pipe 2 is proportional to friction force acting between the copper pipe 2 and the copper pipe 2, and between the copper pipe 2 and a pallet 4 (or a cushioning material).

On the other hand, when the copper pipe 2 is fed, a bending moment occurs at a feeding part, so that the copper pipe 2 is bent. In accordance with increase in the force required for feeding the copper pipe 2, the bending moment of the feeding part increases and the curvature radius of the copper pipe 2 decreases. When this curvature radius is too small (and smaller than a limit curvature radius), the copper pipe is broken due to generation of the plastic buckling (the kink occurs). In other words, a necessary condition for preventing the kink during the feeding of the copper pipe is to satisfy that "a resistance force for feeding a copper pipe (a force required for feeding pipe)≦a maximum force where a copper pipe is not broken (where the plastic buckling does not occur)".

When the copper pipe is fed by using the ETTS method, there is a section sandwiched between a copper pipe and a mount surface (axis-direction non-shift section) of the shift section. For example, in an axis-direction non-shift section of a shift section on the first layer to the second layer (6→2 in FIG. 5, 6→8 in FIG. 8), a maximum load sharing state is supposed as the case where substantially one coil layer is located in a perpendicular and upper direction and a half mass of the next coil layer (on outer-layer side) that is aligned to be fitted into the concave portion between adjacent copper pipes is applied (cf. 1 and 2 in FIG. 5, and 8 in FIG. 7. Herein, a mass of the third coil layer is shared by the second coil layer and the fourth coil layer).

When a coil step number (a winding number in a coil height direction) of the m-th layer is n and the coil step number (the winding number in the coil height direction) of the (m+1)-th layer is n−1, the copper pipes expressed by a following equation (1) are assumed to be piled (stacked) on a pallet or cushioning material, in a maximum load sharing section in the axis-direction non-shift section of the shift section during the copper pipe feeding. It is similar thereto in the case where the step number of the m-th layer is n and the step number of the (m+1)-the layer is n+1.

$$n + \frac{n-1}{2} = \frac{3n-1}{2} \tag{1}$$

Further, the copper pipes expressed by a following equation (2) are assumed to be piled (stacked) on a copper pipe sandwiched by the axis-direction non-shift section.

$$(n-1) + \frac{n-1}{2} = \frac{3n-3}{2} \tag{2}$$

Supposing that the load derived from the equations (1) and (2) is applied over an entire length of the axis-direction non-shift section of the shift section, a maximum resistance force $F_f$ for feeding the copper pipe is assumed to be expressed by a following equation (3) as a sum of the friction forces between the copper pipe 2 and 2, and between the copper pipe 2 and the pallet 4 (or the cushioning material).

$$F_f = L_{NA}\rho_L g\{\mu_{ts}(1.5n^*-0.5)+1.5\mu_{tt}(n^*-1)\} \tag{3}$$

wherein $F_f$: maximum resistance force for feeding copper pipe [N], $L_{NA}$: length of axis-direction non-shift section of shift section [m], $\rho_L$: mass of pipe per unit length [kg/m], g: gravity acceleration [m/s$^2$], $\mu_{ts}$: coefficient of friction between pipe and coil spacer, $\mu_{tt}$: coefficient of friction between adjacent pipes, and n*: winding number of one coil layer in level wound coil. (When the winding number is varied in different layers, n* is the largest number. For example, when the winding numbers are n and n−1, n is n*. When the winding numbers are n and n+1, n+1 is n*.)

In the feeding part, the copper pipe originally with an arc-shape is fed to be drawn to have an elliptical arc-shape. In this process, supposing that an elliptical arc in a major axis direction gets smaller such that both a major axis and a minor axis of an ellipse decrease, i.e. the curvature radius is reduced and the pipe is bent, the bending moment of the feeding part is assumed to be expressed by a following equation (4).

$$M = F_f\sqrt{R_m^{0.5}R^{1.5}} \tag{4}$$

wherein:

M: bending moment [N·m], $R_m$: curvature radius of copper pipe of m-th layer in LWC [m], and R: curvature radius of copper pipe bent in feeding part [m].

On the other hand, in a straight circular pipe (a straight pipe with a circular cross section), the bending moment in the feeding is expressed by following equations (5) to (7).

$$M = Z\sigma_B\left(\frac{d}{R}\right)^{1/3} \tag{5}$$

$$Z = 0.8t(d-t)^2 \quad (t \le 0.06d) \tag{6}$$

$$Z = \frac{0.1\{d^4-(d-2t)^4\}}{d} \quad (t > 0.06d) \tag{7}$$

wherein:

Z: section modulus [m$^3$], $\sigma_s$: tensile strength [Pa], d: outer diameter of pipe [m], and t: average wall thickness of pipe [m].

In the equation (5), preferably 0.015d≦t≦0.057d, and more preferably 0.02d≦t≦0.055d. In the equation (7), preferably 0.062d≦t≦0.3d, and more preferably 0.063d≦t≦0.2d.

In a bent (wound) circular pipe such as the LWC, a following equation (8) can be obtained by replacing the curvature in the equation (5) with a difference in curvatures.

$$M = Z\sigma_B\left\{d\left(\frac{1}{R}-\frac{1}{R_m}\right)\right\}^{1/3} \tag{8}$$

According to the equations (4) and (8), a relationship expressed by a following equation (9) is established between the force required for feeding the pipe and the curvature radius of the pipe.

$$F_f\sqrt{R_m^{0.5}R^{1.5}} = Z\sigma_B\left\{d\left(\frac{1}{R}-\frac{1}{R_m}\right)\right\}^{1/3} \tag{9}$$

On the other hand, in the straight circular pipe (the straight pipe with the circular cross section), it has been known that a minimum curvature radius that does not cause the plastic buckling (a limit curvature radius) is expressed by a following equation (10).

$$\frac{1}{R_{min}} = 4.8\frac{2}{d-t}\left\{2\left(\frac{d}{t}-1\right)^{-1}\right\}^{2.0} N_H^{0.3}\left\{2\left(\frac{d}{t}-1\right)\right\}^{-0.21} \tag{10}$$

wherein:

$R_{min}$: minimum curvature radius that does not cause plastic buckling of circular pipe [m], and $N_H$: work hardening coefficient.

In a bent (wound) and annealed (the work hardening is reset) circular pipe such as the LWC, it is assumed that the plastic buckling does not occur (the kink is not generated) if a curvature difference $\Delta C_m$ in feeding the m-th layer in the LWC is not greater than a maximum curvature difference $\Delta C_{max}$ derived from the equation (10) by replacing the curvature in the equation (10) with a curvature difference.

Further, since $R_m$ increases in the outer layers (in accordance with increase of a distance from a coil center axis), the curvature difference in feeding tends to increase in the outer layers (i.e. when the distance from the coil center axis increases), so that the kink easily occurs. In other words, it is assumed that at least a tolerance on inner-layer side is ensured by controlling the curvature difference in the outermost layer not to be larger than the maximum curvature difference $\Delta C_{max}$ in the LWC. In a narrow means, it is sufficient to control the curvature difference in a layer inside by one layer from the outermost layer not to be larger than the maximum curvature difference $\Delta C_{max}$. Namely, a following equation (11) is established.

$$\Delta C_m \le \Delta C_{out} = \frac{1}{R} - \frac{1}{R_{out}} \le \Delta C_{max} = 4.8\frac{2}{d-t}\left\{2\left(\frac{d}{t}-1\right)^{-1}\right\}^{2.0} N_H^{0.3}\left\{2\left(\frac{d}{t}-1\right)\right\}^{-0.21} \tag{11}$$

wherein:

$\Delta C_m$: curvature difference when m-th layer in LWC is fed [$m^{-1}$], $\Delta C_{out}$: curvature difference when outermost layer in LWC is fed [$m^{-1}$], $\Delta C_{max}$: maximum curvature difference that does not cause plastic buckling of circular pipe [$m^{-1}$], and $R_{out}$: curvature radius of pipe in outermost layer in LWC [m].

As described above, when the curvature radius of the bent portion of the pipe is smaller than the limit curvature radius, the plastic buckling occurs so that the pipe is broken (the kink is generated). Therefore, according to the equations (9) and (11), a maximum force for feeding the pipe without breaking the pipe (without the kink) is expressed by a following equation (12).

$$F_{max} = \frac{Z\sigma_B(\Delta C_{max}d)^{1/3}}{\sqrt{R_{out}^{0.5}R^{1.5}}} \tag{12}$$

$$R = \left(\frac{1}{R_{out}} + \Delta C_{max}\right)^{-1} \tag{13}$$

wherein:

$F_{max}$: maximum force for feeding circular pipe without causing plastic buckling [N].

For feeding the copper pipe without generating the kink in the ETTS method, as a necessary conditions the force required for feeding the copper pipe 2 (F[N]) at least satisfies the condition "$F \leqq F_{max}$". On the other hand, as understood from FIGS. 5 to 8 and the equation (3), it is assumed that the force F required for feeding the copper pipe is smaller than the maximum resistance force $F_f$ for feeding the copper pipe ($F<F_f$). By controlling the axis-direction non-shift section length $L_{NA}$ in the shift section to satisfy the condition "$F_f \leqq F_{max}$", at least the condition "$F<F_{max}$" is established, so that the sufficient condition is satisfied. Namely, according to the equations (3) and (12), the condition for feeding the pipe without generating the plastic buckling (the kink) in the LWC wound by using the ETTS method is expressed by a following equation (15).

$$L_{NA}\rho_L\{\mu_{ts}(1.5n^* - 0.5) + 1.5\mu_{tt}(n^* - 1)\} \le \frac{Z\sigma_B(\Delta C_{max}d)^{1/3}}{\sqrt{R_{out}^{0.5}R^{1.5}}} \tag{14}$$

$$L_{NA} \le \frac{Z\sigma_B(\Delta C_{max}d)^{1/3}}{\rho_L g\{\mu_{ts}(1.5n^* - 0.5) + 1.5\mu_{tt}(n^* - 1)\}R_{out}^{1/4}R^{3/4}} = L_{max} \tag{15}$$

Here, $$Z = 0.8t(d-t)^2 \quad (t \le 0.06d) \tag{6}$$

$$Z = \frac{0.1\{d^4 - (d-2t)^4\}}{d} \quad (t > 0.06d) \tag{7}$$

$$\Delta C_{max} = 4.8\frac{2}{d-t}\left\{2\left(\frac{d}{t}-1\right)^{-1}\right\}^{2.0} N_H^{-0.3}\left\{2\left(\frac{d}{t}-1\right)^{-1}\right\}^{-0.21} \tag{11}$$

$$R = \left(\frac{1}{R_{out}} + \Delta C_{max}\right)^{-1} \tag{13}$$

wherein:

$L_{max}$: allowable sandwiched length for feeding circular pipe without generating plastic buckling [m].

Next, a relationship between a mass W of the LWC and the curvature radius $R_{out}$ of the pipe in the outermost layer in the LWC will be considered.

Firstly, the curvature radius $R_{out}$ of the pipe in the outermost layer in the LWC, an outer diameter $D_{out}$ of the LWC, and the mass W of the LWC are expressed by following equations respectively.

$$R_{out} = \frac{D_{in}}{2} + \frac{1}{2}d\{1 + \sqrt{3}(m-1)\} \tag{16}$$

$$D_{out} = 2R_{out} + d \tag{17}$$

$$W = \pi\rho_L m\left(n^* - \frac{1}{2}\right)\left[D_{in} + d\left\{\frac{\sqrt{3}(m-1)}{2} + 1\right\}\right] \tag{18}$$

wherein:

m: number of layers of copper pipe in LWC, $D_{in}$: inner diameter of LWC [m], $D_{out}$: outer diameter of LWC [m], and W: mass of LWC [kg].

By solving the equation (18) about m, a following equation (19) can be obtained.

$$m = \frac{-\frac{1}{2}\left\{D_{in} + d\left(1 - \frac{\sqrt{3}}{2}\right)\right\} + \sqrt{\frac{1}{4}\left\{D_{in} + d\left(1 - \frac{\sqrt{3}}{2}\right)\right\}^2 + \frac{\sqrt{3}\,Wd}{2\pi\rho_L\left(n^* - \frac{1}{2}\right)}}}{\frac{\sqrt{3}}{2}d} \quad (19)$$

By assigning the equation (19) to the equation (16), it is conceived that a positive correlation is established between $R_{out}$ and W. Namely, by controlling the mass W of the LWC, it is possible to control the curvature radius $R_{out}$ of the pipe in the outermost layer in the LWC. Under the condition where $D_{in}$ and n* are fixed, when W is reduced, $R_{out}$ is also reduced.

According to the above consideration, it is conceived that it is sufficient to satisfy the condition expressed by the equation (15) for preventing the generation of the kink at the lower surface of the LWC when the copper pipe is fed by the ETTS method. Herein, items normally designated by the customers are the specification of the copper pipe (the outer diameter d of the pipe, the mass $\rho_L$ of the pipe per unit length, or the average wall thickness t of the pipe), the inner diameter $D_{in}$ of the LWC, and the like.

Accordingly, control factors in the present invention are "the length $L_{NA}$ of the axis-direction non-shift section of the shift section", "the winding number n* of one coil layer in the LWC (when the winding number is varied in the different layers, n* is the largest number)", or "the curvature radius $R_{out}$ of the pipe in the outermost layer in the LWC, that is adjusted by controlling the mass W of the LWC".

Needless to say, it is preferable to control the length $L_{NA}$ of the axis-direction non-shift section of the shift section so as to satisfy the equation (15) for achieving the effect of the present invention.

In addition, it is conceived that the tolerance (degree of freedom in setting) of $L_{NA}$ is varied by controlling the winding number n* of one coil layer in the LWC (when the winding number is varied in the different layers, n* is the largest number). For example, the tolerance (degree of freedom in setting) of $L_{NA}$ can be enlarged by increasing a value of right-hand side of the equation (15).

Further, it is preferable to control the curvature radius $R_{out}$ of the pipe in the outermost layer in the LWC to be small by control the mass W of the LWC. Other symbols are considered as constant numbers that are determined unambiguously by the specification designated by the customers.

Figure 11:
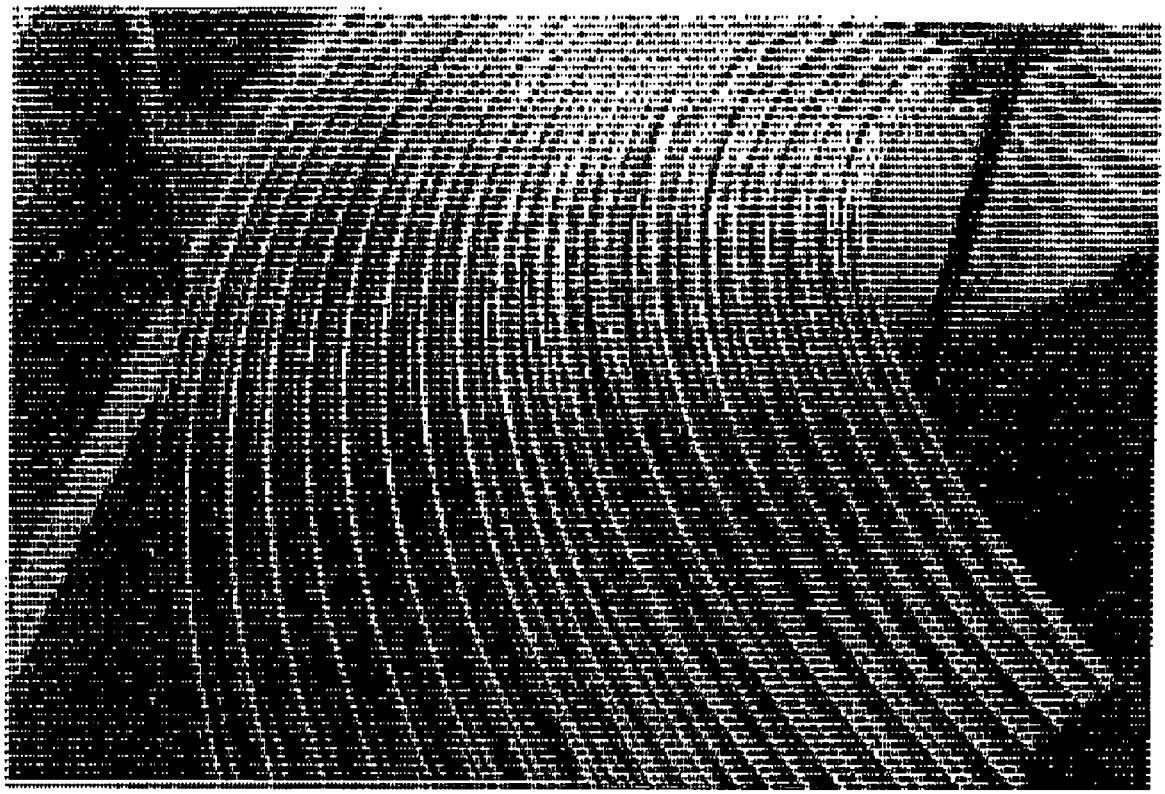
FIG. 11 is a photograph showing a part of a shift section on the bottom surface of an LWC.

FIG. 11 is a photograph showing a part of a shift section on the bottom surface of an LWC. It is found in FIG. 11 that the pipe winding of about the eighth to ninth layers from the innermost layer is different from those of the other layers. This part is a part of the shift section.

Other Embodiments of Invention

Figure 12A:
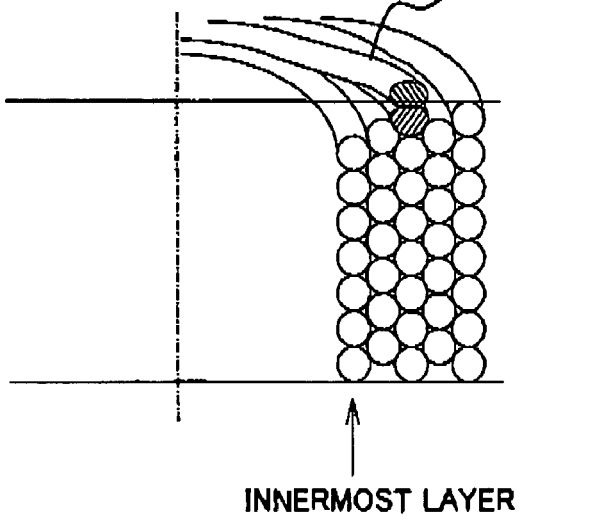
FIG. 12A is a schematic cross sectional view showing an LWC in a comparative example.
Figure 12B:
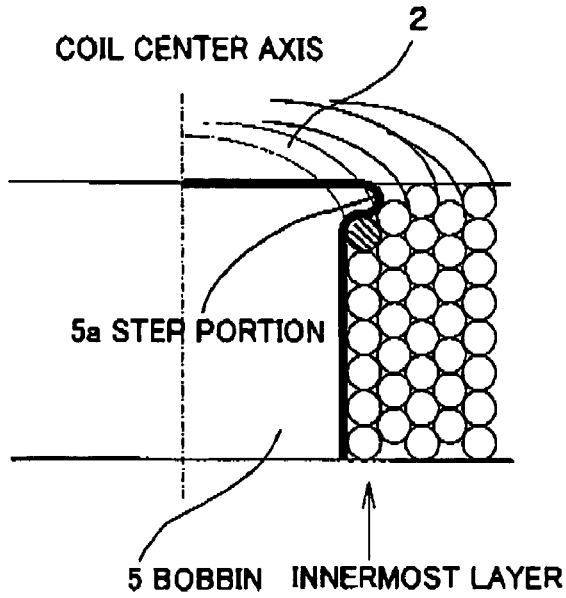
FIG. 12B is a schematic cross sectional view showing an LWC in an embodiment of the invention.
Figure 13A:
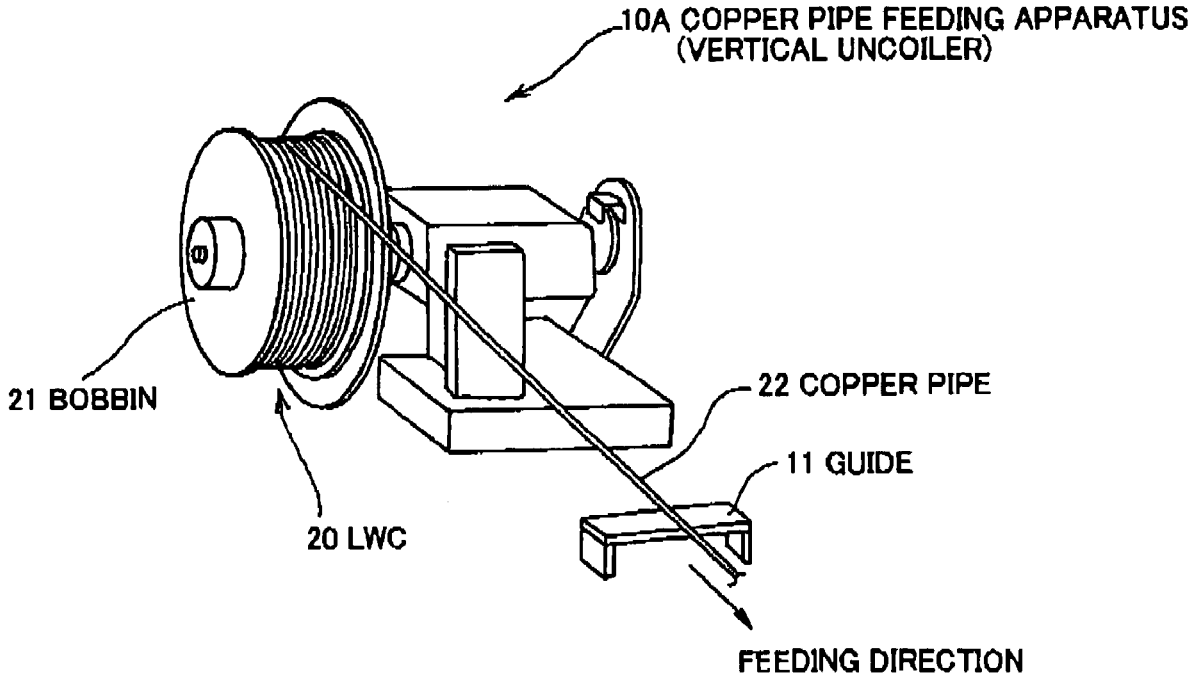
FIG.13A PRIOR ART
FIG. 13A is a perspective view showing the conventional copper pipe feeding apparatus (vertical uncoiler)
Figure 13B:
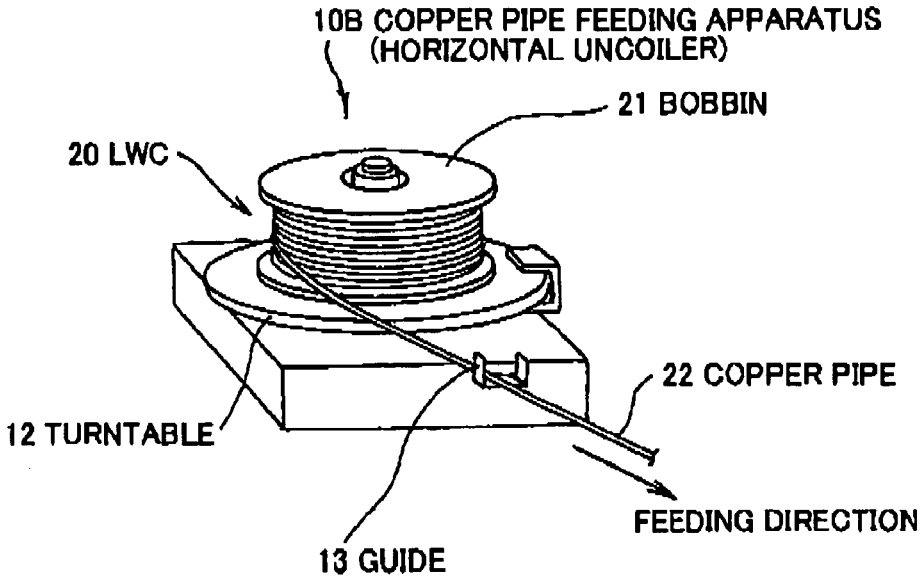
FIG.13B PRIOR ART
FIG. 13B is a perspective view showing the conventional copper pipe feeding apparatus (horizontal uncoiler)
Figure 14:
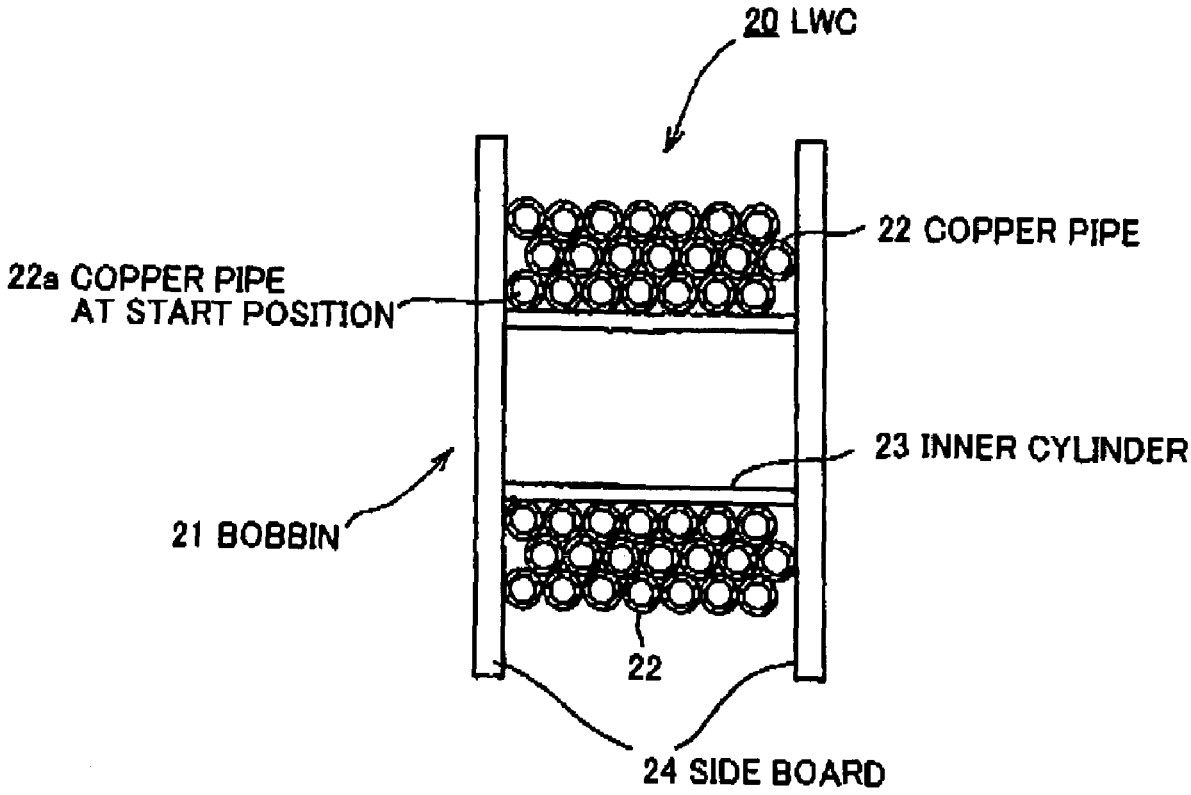
FIG.14 PRIOR ART
FIG. 14 is a schematic cross sectional view showing a detailed arrangement of LWC coiled around a bobbin in FIG. 13A or 13B.
Figure 15:
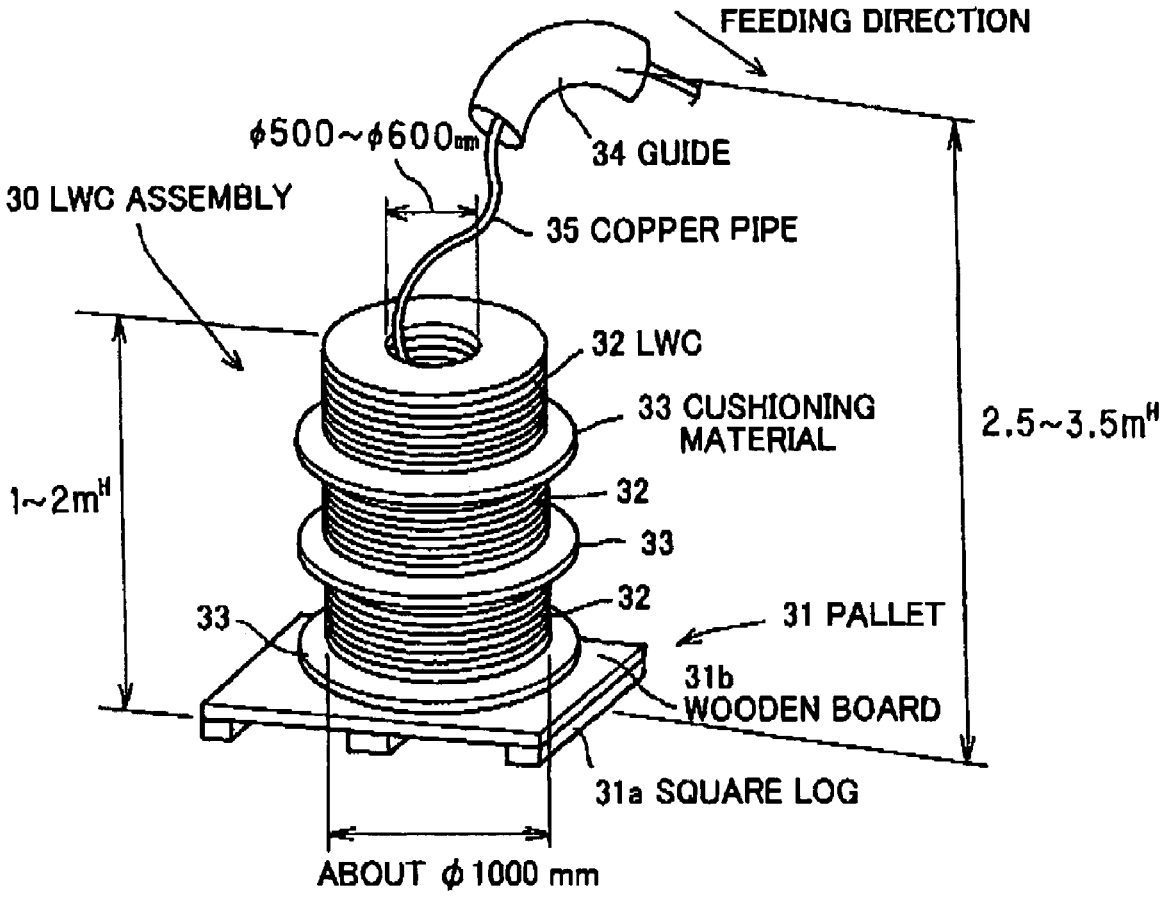
FIG.15 PRIOR ART
FIG. 15 is a perspective view showing a method of feeding a copper pipe by the ETTS method.
Figure 16:
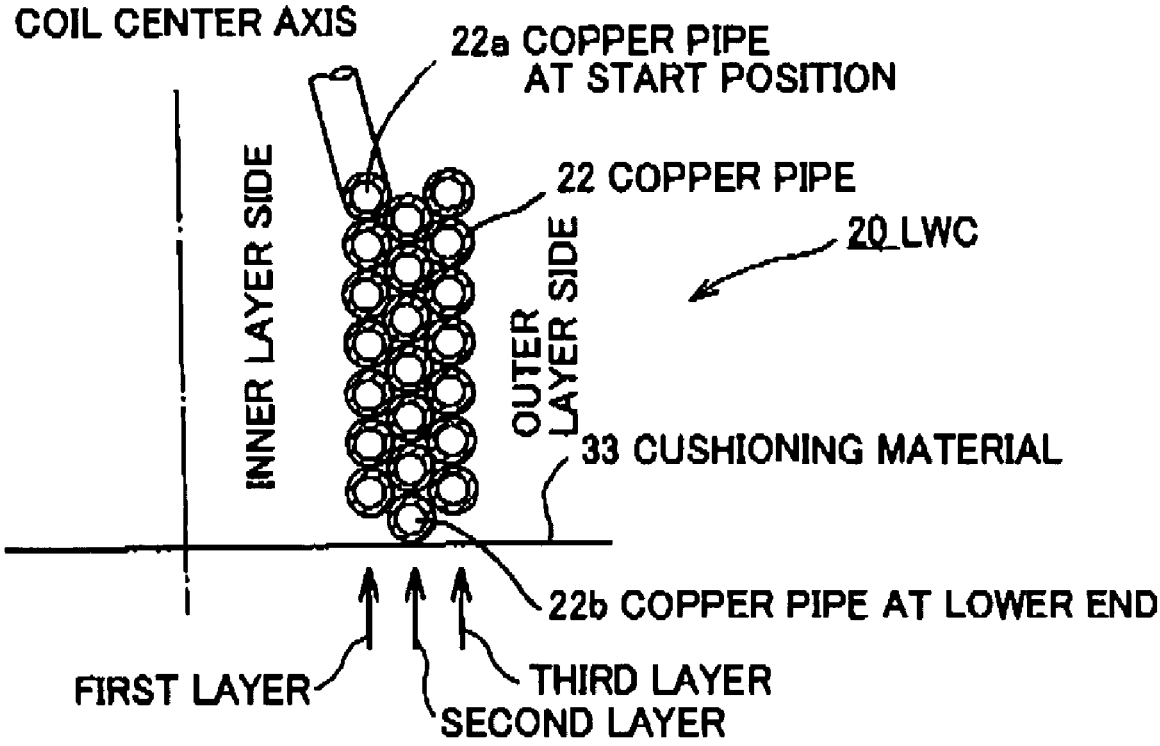
FIG.16 PRIOR ART
FIG. 16 is a schematic cross sectional view illustrating an uncoiling method in LWC.
Figure 17:
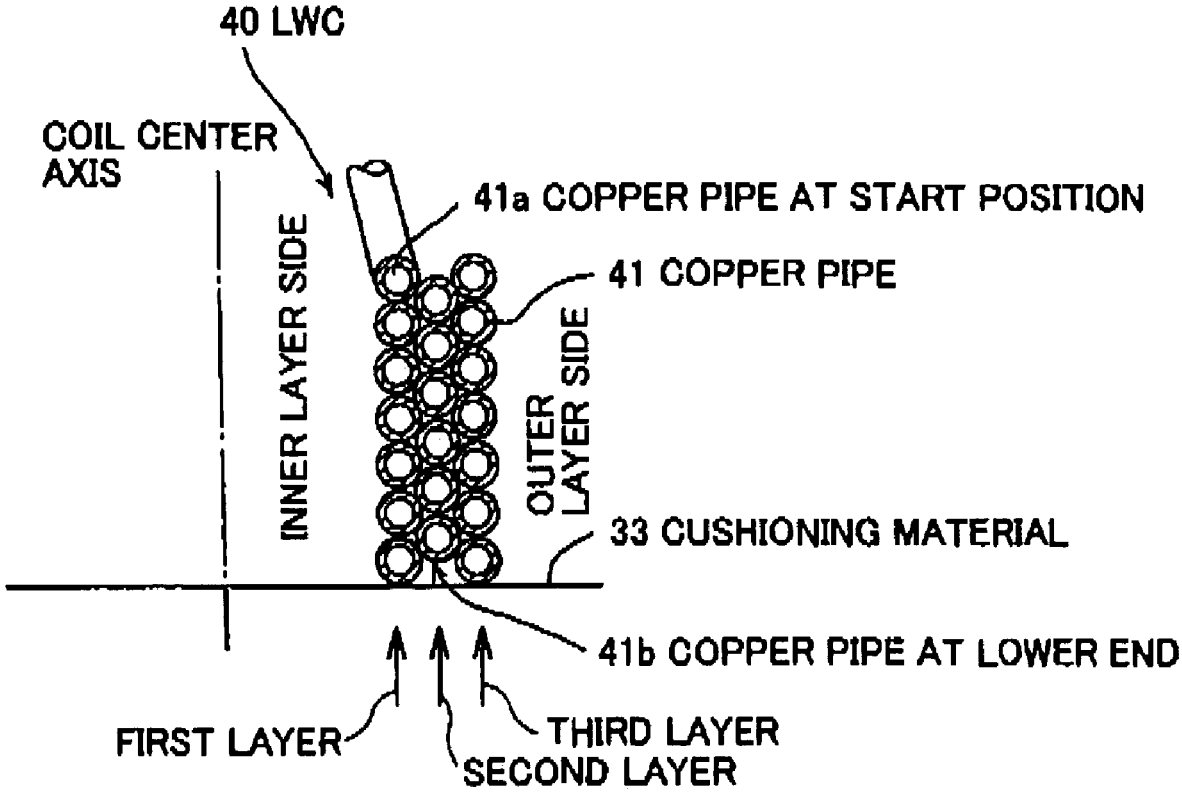
FIG.17 PRIOR ART
FIG. 17 is a schematic cross sectional view illustrating an uncoiling method to facilitate the feeding of a copper pipe at lower end.
Figure 18:
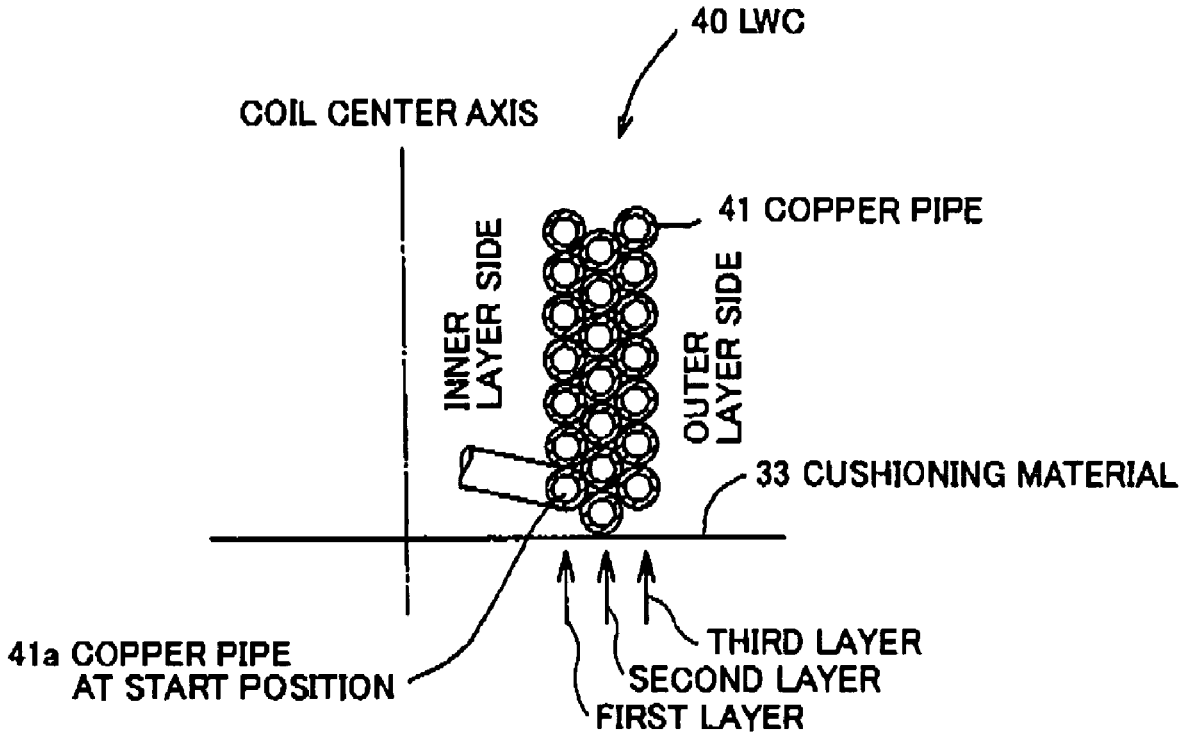
FIG.18 PRIOR ART
FIG. 18 is a schematic cross sectional view illustrating another uncoiling method to facilitate the feeding of a copper pipe at lower end.

FIG. 12A is a schematic cross sectional vies showing an LWC in a comparative example, and FIG. 12B is a schematic cross sectional view showing an LWC in an embodiment of the invention.

FIG. 12A shows a situation (in the comparative example) that an end portion of an innermost-layer copper pipe 2 is shifted on or protruded from the coil end surface to deform a pipe of the other layer when plural LWC's are stacked with the innermost-layer copper pipe wound up to the coil end surface. FIG. 12B shows a structure that can solve this problem, where the innermost layer is (n−i) in winding number where i=0 and the winding number of the second layer from the innermost layer is n, by providing a step portion 5*a* with one end of the bobbin 5 in winding the copper pipe (or in producing the LWC) in order that the end portion of the innermost layer is not shifted on nor protruded from the coil end surface even after the bobbin 5 is removed. The winding number (n−i) of the innermost layer is not always limited to i=0 and may be suitably changed according to a degree of spring-back phenomenon (i.e., a phenomenon of the pipe end portion protruding from the coil end surface) of a copper pipe. The value i is preferably a positive integer of i=0 to 2. Namely, provided that the innermost layer is the first layer of an LWC and that the winding number of the second layer and an even-numbered layer thereafter is n, it is desired that the first layer is n or less, i.e., n, n−1 and n−2, in winding number.

Composition of LWC Package

The package of the invention has a composition similar to that disclosed in JP-A-2002-370869. However, it is different from the conventional package in that the shift section is located according to the invention on the bottom surface of LWC. Therefore, the package can significantly reduce the pipe trapping phenomenon at the shift section during the pipe feeding.

Method of Manufacturing Package

The LWC package of the invention can be made by the conventional method, where the LWC package comprises a bag (envelope) or case to house the whole LWC, and a strip resin film to fasten the side face of the LWC. For example, it can be made by using the method disclosed in JP-A-2002-370869. However, it is different from the conventional package in that the LWC of the invention is used.

EXAMPLE 1

An example of the invention will be described below.

By using copper pipes with different dimension specifications (an outer diameter d and an average wall thickness t of a copper pipe), samples of LWC that are substantially uniform in an inner diameter $D_{in}$ of the LWC, a coefficient $\mu_{ts}$ of friction between the pipe and a coil spacer, and a coefficient $\mu_{tt}$ of friction between adjacent pipes are manufactured. The LWC samples were installed on the coil spacer, and the ETTS feeding test was conducted. As materials of the copper pipe, oxygen-free copper (JIS H3300 C1020, ASTM B111 C10200) and phosphorous-deoxidized copper (JIS H3300 C1220, ASTM B111 C12200) are used. Four coils are manufactured for each specification, such that the shift sections are located according to the embodiment as shown in FIG. 1. At this time, two coils in that the length $L_{NA}$ of the axis-direction non-shift section are adjusted to satisfy the equation (15) are prepared (one coil is made of the oxygen-free copper, and another coil is made of the phosphorous-deoxidized copper), and two coils in that the length $L_{NA}$ of the axis-direction non-shift section does not partially satisfy the equation (15) are prepared (one coil is made of the oxygen-free copper, and another coil is made of the phosphorous-deoxidized copper).

In addition, since the LWC annealed and tempered are used, the work hardening coefficient is assumed as "$N_H$=0.4" for an annealed material (O material). As the coil spacer, a material manufactured by laminating (adhering) three sheets of both side-corrugated cardboards with a thickness of about 3 mm is used. One sheet of corrugated cardboard comprises that a front sheet is made of Kraftliner (K180), a core is made of semi-Kraft pulp (SCP120) and a back sheet is made of the Kraftliner (K180).

Further, samples cut from LWCs that are separately prepared according to the specifications similar to those of the LWCs for the feeding test are used for evaluating "the coefficient $\mu_{ts}$ of the friction between the pipe and the coil spacer" and "the coefficient $\mu_{tt}$ of the friction between the adjacent pipes". Test results obtained by using a friction coefficient testing apparatus (manufactured by ORIENTEC Co., Ltd., type: EFM-4) are $\mu_{ts}\approx 0.3$ and $\mu_{tt}\approx 0.3$, respectively. Common conditions are shown in table 1.

TABLE 1

| Item | Symbol | Unit | Condition |
|---|---|---|---|
| Inner diameter of LWC | $D_{in}$ | m | 0.56 |
| Density of copper pipe material (C1020, C1220) | | $kg/m^3$ | $8.9 \times 10^3$ |
| Gravity acceleration | g | $m/s^2$ | 9.8 |
| Tensile strength (*1) | $\sigma_B$ | MPa | $2.2 \times 10^2$ |
| Work hardening coefficient | $N_H$ | | 0.4 |
| Coefficient of friction between copper pipe and coil spacer | $\mu_{ts}$ | | 0.3 |
| Coefficient of friction between adjacent copper pipes | $\mu_{tt}$ | | 0.3 |
| Copper pipe feeding speed | | m/s | 1 |

(*1) Technical reference: Metals Handbook Ninth Edition, vol.2, American Society for Metals, OH, US (1979)

TABLE 2

| Outer diameter d [mm] | Average wall thickness t [mm] | Mass of coil W [kg] | Winding number n | Layer number m | Outer diameter of LWC $D_{out}$ [m] | Allowable sandwiched length $L_{max}$ [m] | Axis-direction non-shift section length $L_{NA}$ [m] | Generation of kink |
|---|---|---|---|---|---|---|---|---|
| 6.35 | 0.29 | $2.3 \times 10^2$ | 55 | 35 | 0.95 | 0.56 | 0.3~0.5 | NO |
| | | | | | | | 0.5~0.7 | YES |
| 7 | 0.29 | $2.3 \times 10^2$ | 50 | 35 | 1 | 0.51 | 0.3~0.5 | NO |
| | | | | | | | 0.5~0.8 | YES |
| 7 | 0.33 | $2.7 \times 10^2$ | 50 | 35 | 1 | 0.67 | 0.4~0.6 | NO |
| | | | | | | | 0.6~0.9 | YES |
| 8 | 0.32 | $2.6 \times 10^2$ | 46 | 33 | 1 | 0.81 | 0.4~0.7 | NO |
| | | | | | | | 0.7~1 | YES |

The feeding test was conducted for the LWC samples (16 coils in total), that were prepared in accordance with four kinds of copper pipe specifications (the outer diameter d and the average wall thickness t of the pipe) as shown in table 2 and made of two kinds of copper pipe raw materials (the oxygen-free copper, the phosphorous-deoxidized copper), under two conditions in that the length $L_{NA}$ of the axis-direction non-shift section of each shift section satisfies or not the equation (15), so as to analyze trappings (kink, plastic buckling) of the pipe during the feeding.

As a result of the test, for the coils in that the length $L_{NA}$ of the axis-direction non-shift section of each shift section satisfies the equation (15) (8 coils in total), no occurrence of kink (plastic buckling) was observed. On the other hand, for the coils in that the length $L_{NA}$ of the axis-direction non-shift section of each shift section does not partially satisfy the equation (15) (8 coils in total), the trapping happened for plural times during the feeding of the copper pipe, and the generation of kink (plastic buckling) was observed.

From the above test results, it is assumed that it is effective to control the length $L_{NA}$ of the axis-direction non-shift section of the shift section not to be longer than the allowable sandwiched length $L_{max}$ for feeding the circular pipe without causing the plastic buckling, so as to solve the troubles such as the trapping or the like in the shift section when the copper pipe is fed from the LWC in the ETTS method.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A method of manufacturing a level wound coil (LWC) comprising the steps of:

providing a plurality of coil layers each of which comprises a pipe wound in alignment winding and in traverse winding;

locating a coil of a (m+1)-th coil layer such that a pipe at a start position thereof is fitted into a concave part formed outside of the m-th coil layer and between a pipe at a lower end and its adjacent pipe of a m-th coil layer, where, when the LWC is disposed on a mount surface perpendicular to a coil center axis of the LWC, m is an odd natural number if a start position of the winding of the LWC is located at an upper end and m is an even natural number if the start position is located at a lower end;

locating a shift section where the pipe is shifted from the m-th coil layer to the (m+1)-th coil layer on a bottom surface thereof when the LWC is disposed on the mount surface perpendicular to the coil center axis;

locating a part or a total of a start point of the (k+1)-th shift section on an outer layer side not to transit, relative to a start point of the k-th shift section on an inner layer side, to a direction reverse to a winding direction of the pipe, and controlling a length of the shift section that does not transit to the reverse direction when the pipe is shifted until the pipe at the start position of the (m+1)-th coil layer is fitted into the concave part formed outside of the m-th coil layer.

2. The method according to claim 1, wherein:

the shift section that does not transit to the reverse direction comprises an axis-direction non-shift section that is not shifted to a direction of the coil center axis, and a length ($L_{NA}$) of the axis-direction non-shift section is controlled in the step of controlling the length of the shift section that does not transit to the reverse direction.

3. The method according to claim 2, wherein:

the length ($L_{NA}$) of the axis-direction non-shift section is controlled to satisfy a following equation:

$$L_{NA} \leq \frac{Z\sigma_B(\Delta C_{max}d)^{1/3}}{\rho_L g\{\mu_{ts}(1.5n^* - 0.5) + 1.5\mu_{tt}(n^* - 1)\}R_{out}^{1/4}R^{3/4}} = L_{max}$$

wherein:

$L_{NA}$: length of axis-direction non-shift section of shift section [m], $\rho_L$: mass of pipe per unit length [kg/m], g: gravity acceleration [m/s$^2$], $\mu_{ts}$: coefficient of friction between pipe and coil spacer, $\mu_{tt}$: coefficient of friction between adjacent pipes, n*: winding number of one coil layer in LWC (When the winding number is varied in different layers, n* is the largest number, $R_{out}$: curvature radius of pipe in outermost layer of LWC [m], R: curvature radius of copper pipe bent in feeding part [m], Z: section modulus [m$^3$], $\sigma_B$: tensile strength [Pa], $\Delta C_{max}$: maximum curvature difference that does not cause plastic yeild of circular pipe [m$^{-1}$], and d: outer diameter of pipe [m].

4. A LWC comprising:

a plurality of coil layers each of which comprises a pipe wound in alignment winding and in traverse winding, a coil of a (m+1)-th coil layer being located such that a pipe at a start position thereof is fitted into a concave part formed outside of the m-th coil layer and between a pipe at a lower end and its adjacent pipe of a m-th coil layer, where, when the LWC is disposed on a mount surface perpendicular to a coil center axis of the LWC, m is an odd natural number if a start position of the winding of the LWC is located at an upper end and m is an even natural number if the start position is located at a lower end, wherein the LWC comprises a shift section where the pipe is shifted from the m-th coil layer to the (m+1)-th coil layer on a bottom surface thereof when the LWC is disposed on the mount surface perpendicular to the coil center axis, the shift section comprises a k-th shift section on an inner layer side and a (k+1)-th shift section on an outer layer side, where a part or a total of a start point of the (k+1)-th shift section does not transit, relative to a start point of the k-th shift section, to a direction reverse to a winding direction of the pipe, and a length of the shift section that does not transit to the reverse direction is adjusted when the pipe is shifted until the pipe at the start position of the (m+1)-th coil layer is fitted into the concave part formed outside of the m-th coil layer.

5. The LWC according to claim 4, wherein:

the shift section that does not transit to the reverse direction comprises an axis-direction non-shift section that is not shifted to a direction of the coil center axis, and a length ($L_{NA}$) of the axis-direction non-shift section is controlled in controlling the length of the shift section that does not transit to the reverse direction.

6. The LWC according to claim 5, wherein:

the length ($L_{NA}$) of the axis-direction non-shift section is controlled to satisfy a following equation:

$$L_{NA} \leq \frac{Z\sigma_B(\Delta C_{max}d)^{1/3}}{\rho_L g\{\mu_{ts}(1.5n^* - 0.5) + 1.5\mu_{tt}(n^* - 1)\}R_{out}^{1/4}R^{3/4}} = L_{max}$$

wherein:

$L_{NA}$: length of axis-direction non-shift section of shift section [m], $\rho_L$: mass of pipe per unit length [kg/m], g: gravity acceleration [m/s$^2$], $\mu_{ts}$: coefficient of friction between pipe and coil spacer, $\mu_{tt}$: coefficient of friction between adjacent pipes, n*: winding number of one coil layer in LWC (When the winding number is varied in different layers, n* is the largest number), $R_{out}$: curvature radius of pipe in outermost layer of LWC [m], R: curvature radius of copper pipe bent in feeding part [m], Z: section modulus [m$^3$], $\sigma_B$: tensile strength [Pa], $\Delta C_{max}$: maximum curvature difference that does not cause plastic buckling of circular pipe [m$^{-1}$], and d: outer diameter of pipe [m].

7. A package for LWC, comprising:

a pallet comprising a mount surface;

the LWC as defined in claim 4, the LWC being disposed in single or stacked in plurality through a cushioning material on the mount surface perpendicular to the coil center axis of the LWC;

an envelope for wrapping a total of the LWC; and a strip resin film provided on a side of the envelope in tension winding.

* * * * *